US012654814B2

(12) United States Patent
Cadigan et al.

(10) Patent No.: US 12,654,814 B2
(45) Date of Patent: Jun. 16, 2026

(54) PERSONNEL TRANSFER DEVICE

(71) Applicant: Billy Pugh Company, LLC, Corpus Christi, TX (US)

(72) Inventors: Michael F. D. Cadigan, Houston, TX (US); Paul Liberato, Richmond, TX (US); Christian Thomas Wood, Lodi, WI (US); Jayce Nicole Zuniga, Ingleside, TX (US)

(73) Assignee: Billy Pugh Company, LLC, Corpus Christi, TX (US)

( * ) Notice: Subject to any disclaimer, the term of this patent is extended or adjusted under 35 U.S.C. 154(b) by 0 days.

(21) Appl. No.: 18/938,639

(22) Filed: Nov. 6, 2024

(65) Prior Publication Data

US 2025/0145254 A1 May 8, 2025

Related U.S. Application Data

(60) Provisional application No. 63/596,410, filed on Nov. 6, 2023.

(51) Int. Cl.
*B63B 27/16* (2006.01)
*B63C 9/02* (2006.01)

(52) U.S. Cl.
CPC ..... *B63B 27/16* (2013.01); *B63C 9/02* (2013.01)

(58) Field of Classification Search
CPC ..... B63B 27/16; B63B 27/10; B63B 27/30; B63C 9/02; B66C 1/12; A62B 1/02
See application file for complete search history.

(56) References Cited

U.S. PATENT DOCUMENTS 3,827,745 A 8/1974 Pugh
5,713,710 A * 2/1998 Strong ..... B66C 13/02 114/350
7,121,600 B2 10/2006 Liberato et al.
7,252,315 B2 8/2007 Liberato et al.
8,439,622 B2 5/2013 Strong
(Continued)

OTHER PUBLICATIONS

International Search Report and Written Opinion issued in International application No. PCT/US2024/054684 filed Nov. 6, 2024, 11 pgs.

(Continued)

*Primary Examiner* — Lynn E Schwenning
(74) *Attorney, Agent, or Firm* — Haynes and Boone, LLP

(57) ABSTRACT

A personnel transfer device includes a base, a top, a plurality of generally peripherally-disposed cables extending between the base and the top, a generally centrally-disposed support column coupled between the base and the top for maintaining a generally-fixed distance between the base and the top and for providing tension in the plurality of generally peripherally-disposed cables extending between the base and the top, and a heave compensator configured to provide damping of motion of a first end thereof relative to a second end thereof, the heave compensator disposed generally longitudinally within a lateral extent of the generally centrally-disposed support column. In some embodiments, the first end of the heave compensator is attached to the generally centrally-disposed support column, and the second end of the heave compensator is configured for coupling to a master link assembly for lifting of the personnel transfer device.

25 Claims, 23 Drawing Sheets

(56) References Cited

U.S. PATENT DOCUMENTS

| | | | | |
|---|---|---|---|---|
| 8,591,162 | B2 | 11/2013 | Strong | |
| 8,757,954 | B1 * | 6/2014 | Roy | B63B 27/16 414/137.5 |
| 9,670,037 | B2 * | 6/2017 | Morice, III | B66C 13/02 |
| 10,099,757 | B2 | 10/2018 | Strong et al. | |
| 10,118,675 | B2 | 11/2018 | Strong | |
| 10,766,579 | B1 * | 9/2020 | Kerns, IV | B63B 27/36 |
| 2005/0023853 | A1 * | 2/2005 | Liberato | B66C 1/127 294/77 |
| 2010/0252365 | A1 | 10/2010 | Feller | |
| 2016/0288881 | A1 * | 10/2016 | Strong | B63B 27/16 |
| 2018/0057321 | A1 | 3/2018 | Chin | |

OTHER PUBLICATIONS

Keprate, Arvind, "Impact of Passive Heave Compensator on Offshore Lifting", Journal of Shipping and Ocean Engineering, 5 (2015) 166-180.

Woodacre, J.K, Bauer, R.J., Irani, R.A., "A review of vertical motion heave compensation systems", Elsevier, Ocean Engineering 104, (2015) 140-154.

* cited by examiner

PERSONNEL TRANSFER DEVICE

CROSS-REFERENCE TO RELATED APPLICATIONS

The present application claims benefit, under 35 U.S.C. 119(e), of U.S. Provisional Application No. 63/596,410, filed Nov. 6, 2023, the disclosure of which is incorporated by reference herein.

FIELD OF THE DISCLOSURE

This disclosure relates generally to a personnel transfer device, and, more particularly, to a personnel transfer device for offshore use to transfer personnel and/or cargo between floating vessels and offshore drilling or production platforms.

BACKGROUND

In the course of operation, offshore upstream oil and gas businesses may utilize personnel transfer devices, also referred to as personnel transfer carriers or personnel transfer baskets, to transfer personnel between vessels, drilling rigs, and/or other offshore structures. For example, such transfers may be performed for crew changes, for emergency or medical transfers, for evacuation purposes, or for other purposes. In various examples, a crane, or other hoisting means, may be used for lifting, positioning, and transporting personnel using a personnel transfer device. Such personnel transfers inherently pose at least some risks. For example, there are risks of personnel falling from the personnel transfer device, lateral collisions or other impacts, water immersion, or potentially other risks. Moreover, offshore personnel transfer has the potential to be particularly dangerous during high wind and/or rough sea conditions, or when an inexperienced crew is performing the transfer. Thus, it is important that offshore personnel transfers be conducted according to established best practices, including ensuring adequate crew experience, safe environmental conditions, and safe equipment (e.g., such as personnel transfer device, crane, rigging, etc.). In particular, there remains a need to provide enhanced personnel transfer devices with integrated safety features to enable quick, safe, and efficient personnel transfers.

SUMMARY

Systems and methods have been provided for offshore transfer of personnel and/or cargo between floating vessels and offshore drilling or production platforms using a personnel transfer device.

In some embodiments in accordance with the present invention, a personnel transfer device includes a base, a top, a plurality of generally peripherally-disposed cables extending between the base and the top, a generally centrally-disposed support column coupled between the base and the top for maintaining a generally-fixed distance between the base and the top and for providing tension in the plurality of generally peripherally-disposed cables extending between the base and the top, and a heave compensator configured to provide damping of motion of a first end thereof relative to a second end thereof, the heave compensator disposed generally longitudinally within a lateral extent of the generally centrally-disposed support column. In some embodiments, the first end of the heave compensator is attached to the generally centrally-disposed support column, and the second end of the heave compensator is configured for coupling to a master link assembly for lifting of the personnel transfer device.

In some embodiments, the heave compensator is disposed coaxially with respect to the generally centrally-disposed support column.

In some embodiments, the heave compensator includes a passive heave compensator.

In some embodiments, a center of mass of the heave compensator is disposed within a lower portion of the generally centrally-disposed support column.

In some embodiments, the personnel transfer device further includes plural floatation modules coupled to upper portions of respective pairs of adjacent cables of the plurality of generally peripherally-disposed cables, a first lateral end of each floatation module attached to an upper portion of a first cable of one of the respective pairs of adjacent cables of the plurality of generally peripherally-disposed cables, and a second lateral end of each floatation module attached to an upper portion of a second cable of the one of the respective pairs of adjacent cables of the plurality of generally peripherally-disposed cables.

In some embodiments, the plural floatation modules at least partly define a center of buoyancy of the personnel transfer device. In some embodiments, a center of gravity of the personnel transfer device is disposed below the center of buoyancy.

In some embodiments, the personnel transfer device further includes an opening beneath each of the plural floatation modules, the opening extending from a bottom surface of each of the plural floatation modules to a top surface of the base.

In some embodiments, each of the plural floatation modules has a total volume of about 2 cubic feet.

In some embodiments, each of the plural floatation modules is configured to provide protection from side impacts to the personnel transfer device.

In some embodiments, when the personnel transfer device is disposed in a body of water, a distance between a bottom surface of the top and a top surface of the body of water is at least 24 inches.

In some embodiments, the personnel transfer device further includes a plurality lift points disposed along a top portion of the top. In some embodiments, the plurality of lift points are configured for attachment of a set of slings for coupling the top to the master link assembly for lifting of the personnel transfer device.

In some embodiments, the personnel transfer device further includes a heave compensation sling coupled between the second end of the heave compensator and the master link assembly. In some embodiments, upon initiation of the lifting of the personnel transfer device, the heave compensation sling is configured to engage prior to engagement of the set of slings.

In some embodiments, each respective sling of the set of slings has a first length, and wherein the heave compensation sling has a second length greater than the first length.

In some embodiments, engagement of the heave compensation sling, prior to engagement of the set of slings, is configured to dampen dynamic forces on the personnel transfer device during the lifting of the personnel transfer device.

In some embodiments, the plurality of generally peripherally-disposed cables are attached to the base and to the top at corresponding spaced apart locations. In some embodiments, each of the cables has a substantially equal length between a base attachment location and a top attachment location so that tension in the cables causes the top to be substantially parallel to the base.

In some embodiments, the plurality of generally peripherally-disposed cables are attached to the base and to the top at corresponding spaced apart locations toward a periphery of the base and a periphery of the top, and the personnel transfer device further includes a set of inner cables attached to the base and to the top at corresponding spaced apart locations, the set of inner cables attached toward a center of the base and the top.

In some embodiments, the personnel transfer device further includes a first coupling attached to the base for coupling of the generally centrally-disposed support column to the base, a second coupling attached to the top for coupling of the generally centrally-disposed support column to the top, and a metal grated flooring extending between the first coupling and the set of inner cables.

In some embodiments, the base further includes a base spreader ring and a first support structure extending at least partially between the base spreader ring and the first coupling. In some embodiments, the top further includes a top spreader ring and a second support structure extending at least partially between the top spreader ring and the second coupling.

In some embodiments in accordance with the present invention, a method of retrofitting a personnel transfer device having a base, a top, and a plurality of generally peripherally-disposed cables extending between the base and the top and in which, when the personnel transfer device is configured for transport operations, a generally fixed distance between the base and the top is maintained together with tension in the plurality of generally peripherally-disposed cables extending between the base and the top, the method including providing a generally centrally-disposed support column, and providing a heave compensator disposed generally within the generally centrally-disposed support column. In some embodiments, a first end of the heave compensator is attached to the generally centrally-disposed support column. In some embodiments, a second end of the heave compensator is configured for coupling to a master link assembly for lifting of the personnel transfer device during the transport operations.

In some embodiments, the method further includes replacing an existing support column with the generally centrally-disposed support column having the heave compensator disposed generally therewithin, the replacing reestablishing the generally fixed distance between the base and the top and the tension in the plurality of generally peripherally-disposed cables extending between the base and the top.

In some embodiments, the method further includes fixedly attaching floatation modules to upper portions of respective pairs of adjacent ones of the plurality of generally peripherally-disposed cables.

In some embodiments, the method further includes fixedly attaching floatation modules to upper portions of at least a respective one of the plurality of generally peripherally-disposed cables and the top.

In some embodiments, the method further includes replacing a buoyant padding surrounding the base with a non-buoyant padding or non-buoyant bumper.

In some embodiments in accordance with the present invention, an apparatus for marine applications includes a personnel transfer device. In some embodiments, the apparatus further includes a heave compensator configured to be disposed generally longitudinally within a lateral extent of a generally centrally-disposed support column of the personnel transfer device. In some embodiments, a first end of the heave compensator is configured to be attached to the generally centrally-disposed support column, and a second end of the heave compensator is configured for coupling to a master link assembly for lifting of the personnel transfer device. In some embodiments, the apparatus further includes plural floatation modules. In some embodiments, each floatation module is attachable to an upper portion of a respective generally peripherally-disposed cable of the personnel transfer device.

In some embodiments, the heave compensator is disposed generally longitudinally within the lateral extent of the generally centrally-disposed support column of the personnel transfer device, the first end of the heave compensator is attached to the generally centrally-disposed support column, and each floatation module is attached to the upper portion of the respective generally peripherally-disposed cable of the personnel transfer device.

Figure 1:
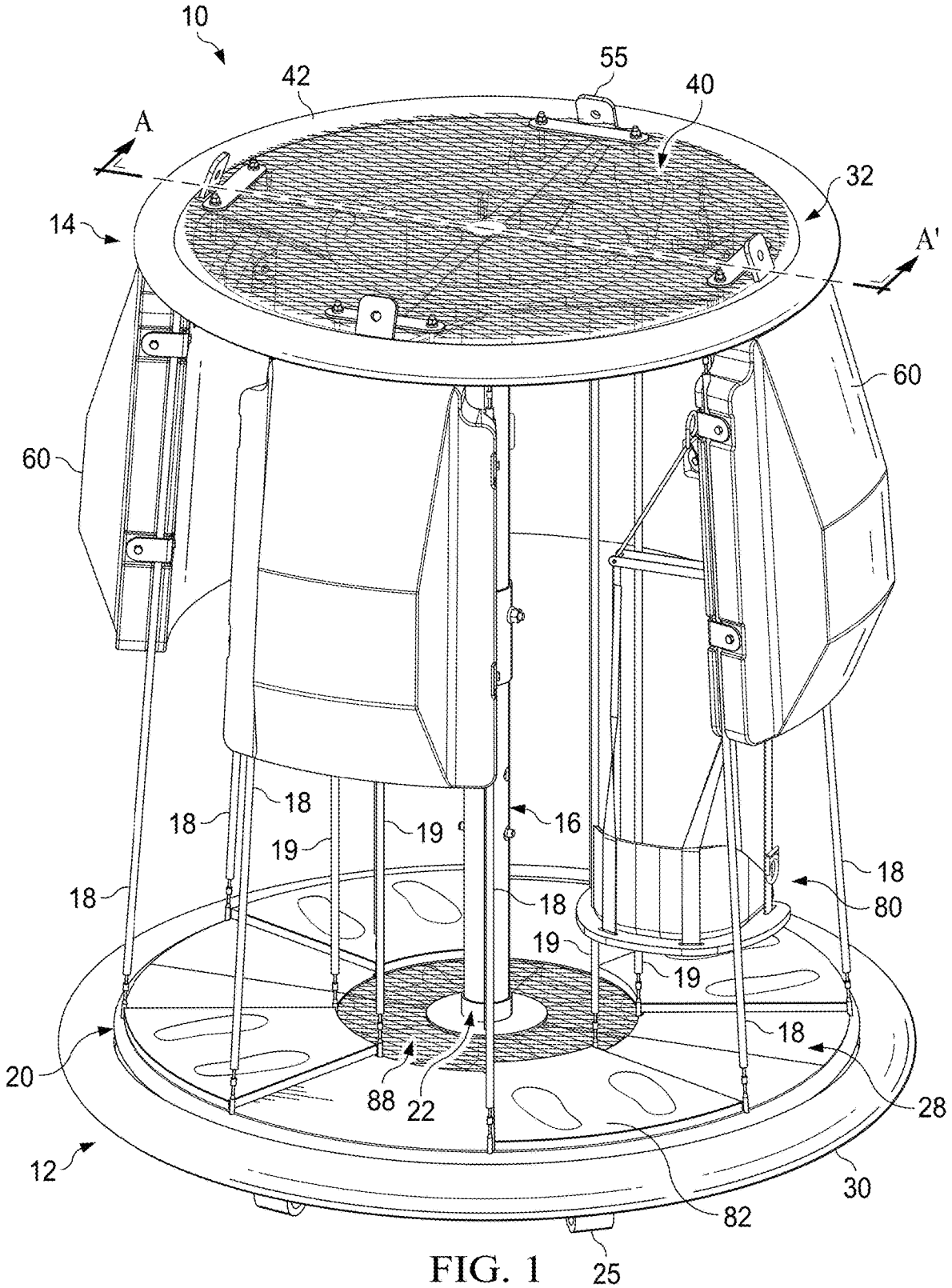
FIG. 1 illustrates a perspective view of a personnel transfer device, in accordance with some embodiments.

Embodiments of the present disclosure may be understood by referring to the detailed description that follows. It should be appreciated that like reference numerals are used to identify like elements illustrated in one or more of the figures, wherein showings therein are for purposes of illustrating embodiments of the present disclosure and not for purposes of limiting the same.

DETAILED DESCRIPTION

Embodiments of the present disclosure include a personnel transfer device for offshore use (or marine applications) to transfer personnel and/or cargo between vessels, drilling rigs, and/or other offshore structures. As discussed above, personnel transfers may be performed for crew changes, for emergency or medical transfers, for evacuation purposes, or for other purposes. As also noted, the lifting, positioning, and transporting of personnel, using the personnel transfer device, may be accomplished by using a crane or other hoisting means. Offshore personnel transfers may pose risks such as personnel falling from the personnel transfer device, lateral collisions or other impacts, water immersion, or potentially other risks. High winds and/or rough sea conditions, as well as an inexperienced crew, can also make offshore personnel transfers particularly dangerous. To mitigate such risks, offshore personnel transfers should be conducted by an experienced crew, under safe environmental conditions, and using safe equipment (e.g., such as personnel transfer device, crane, rigging, etc.). In particular, there remains a need to provide enhanced personnel transfer devices with integrated safety features to enable quick, safe, and efficient personnel transfers.

Embodiments of the present disclosure offer advantages over the existing art, though it is understood that other embodiments may offer different advantages, not all advantages are necessarily discussed herein, and no particular advantage is required for all embodiments. For example, embodiments discussed herein include a personnel transfer device, and related methods, that may be used for offshore personnel transfer. In some embodiments, the personnel transfer device may be lifted and transported using a sling set attached to a frame top portion, the sling set further coupled to a crane, hoist, or other lifting machine. In accordance with various embodiments, and to enhance the safety of an offshore personnel transfer process, the present disclosure provides a personnel transfer device including a number of integrated safety features. By way of example, embodiments disclosed herein may include personnel transfer devices having self-righting floatation, passive heave compensation (e.g., to provide softer pickups and takeoffs), softer cushioned landings, enhanced side impact protection, emergency seating, a floor grating for improved viewing (e.g., by onboard personnel) during landing, or combinations thereof.

In the discussion that follows, various exemplary embodiments will be shown and described with reference to a four (4)-person personnel transfer device. However, it will be understood that the various features described with reference to the 4-person personnel transfer device are exemplary and may be equally applied to personnel transfer devices configured to transport a different number of people such as a six (6)-person personnel transfer device, an eight (8)-person personnel transfer device, a ten (10)-person personnel transfer device, or a twelve (12)-person personnel transfer device. Further, in addition to providing the disclosed personnel transfer device, aspects of the present disclosure also provide methods for retrofitting an existing personnel transfer device to include one or more of the advantageous integrated safety features described herein. Additional details of embodiments of the present disclosure are provided below, and additional benefits and/or other advantages will become apparent to those skilled in the art having benefit of the present disclosure.

Figure 2:
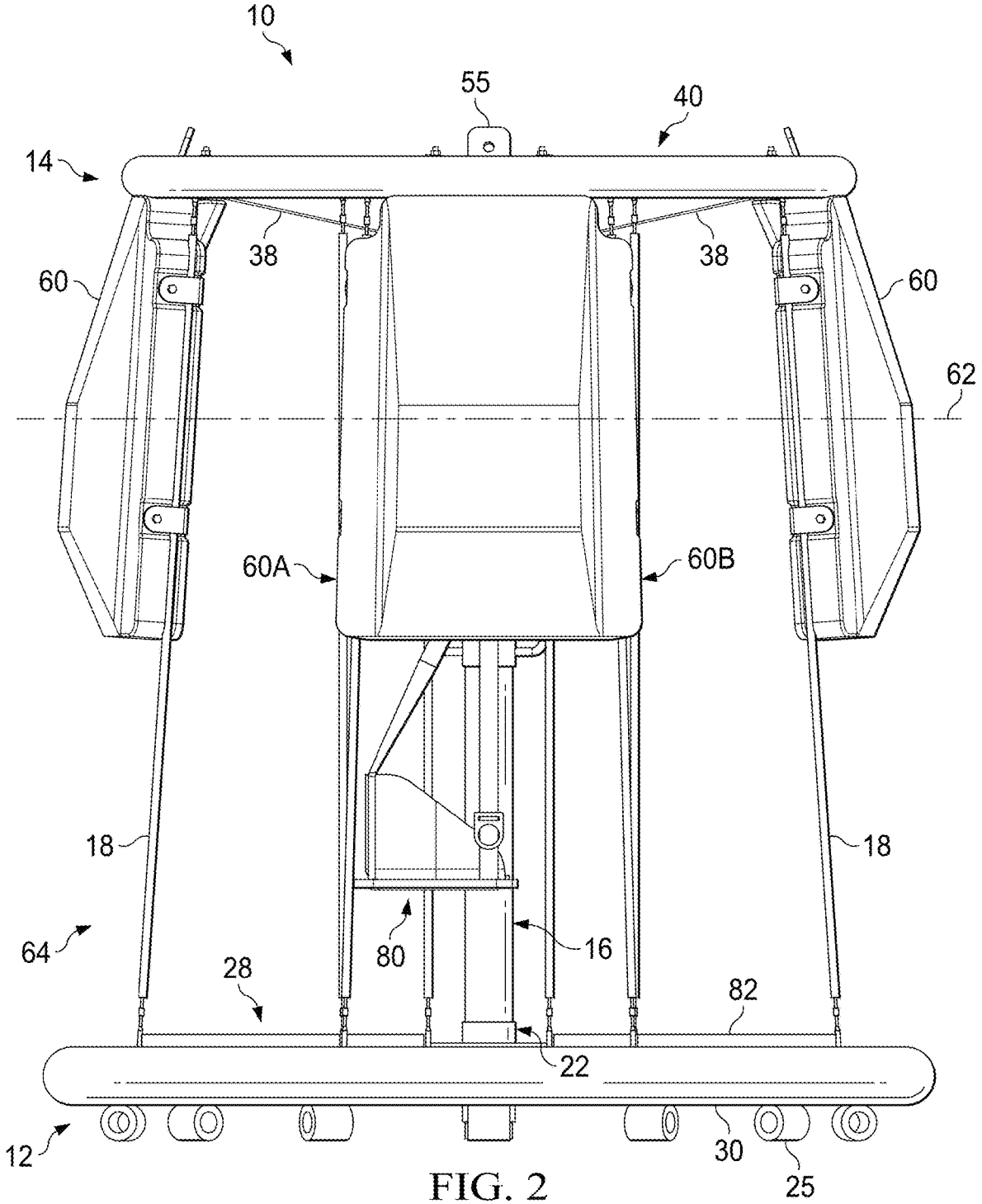
FIG. 2 illustrates a side view of a personnel transfer device, in accordance with some embodiments.
Figure 3:
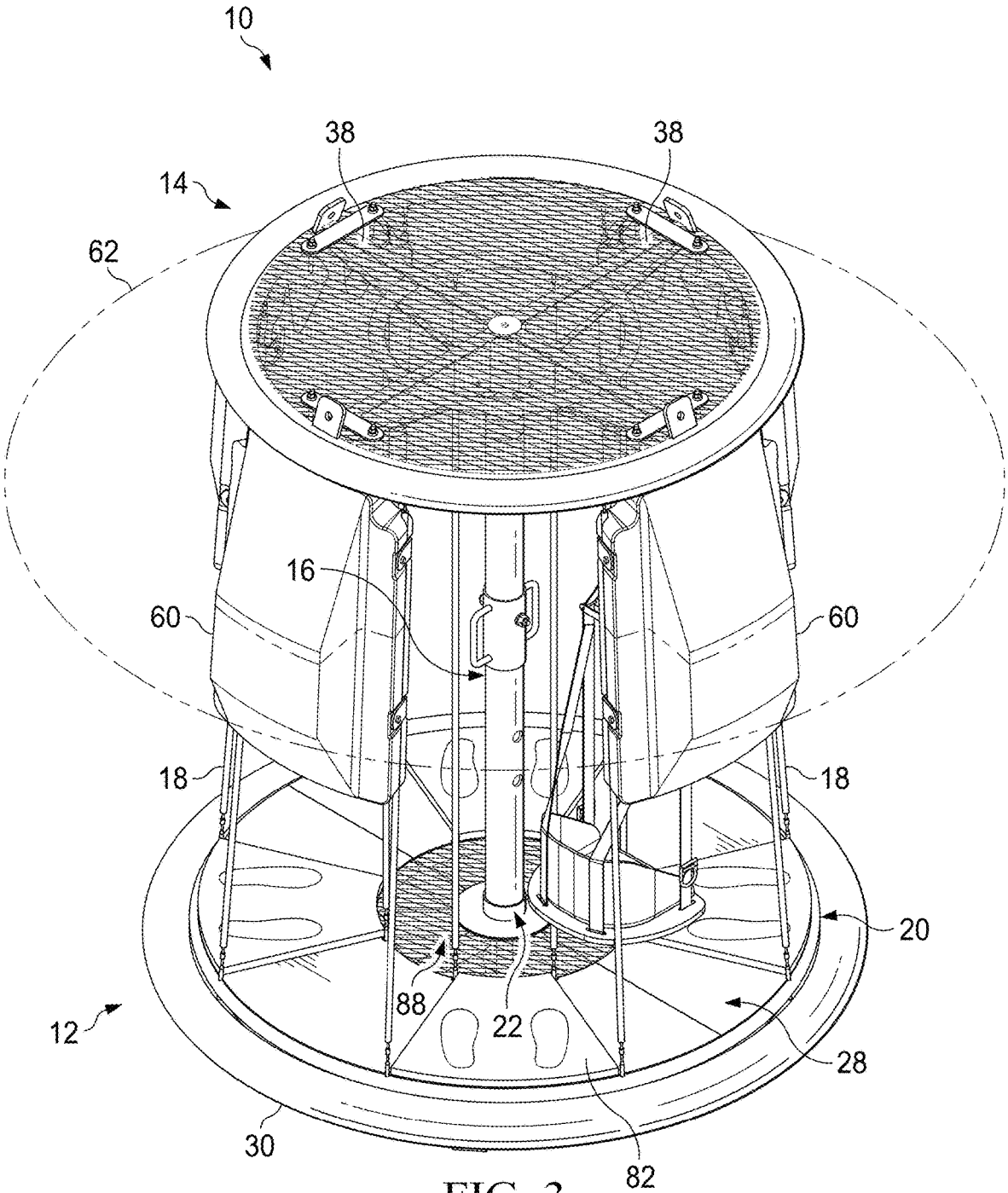
FIG. 3 illustrates another perspective view of a personnel transfer device, in accordance with some embodiments.
Figure 4:
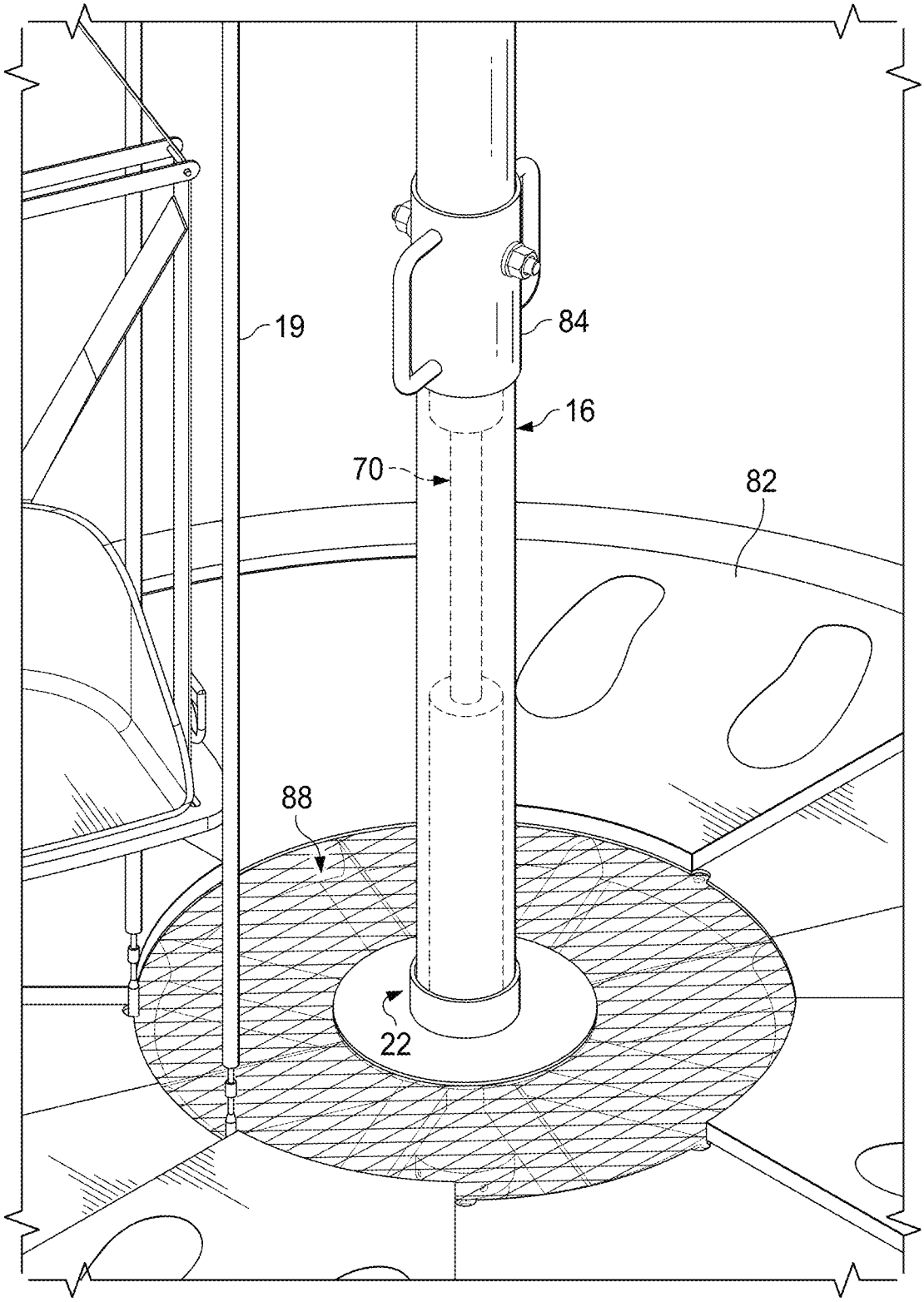
FIG. 4 illustrates a cropped perspective view of a portion of a personnel transfer device including a passive heave compensator, in accordance with some embodiments.
Figure 5:
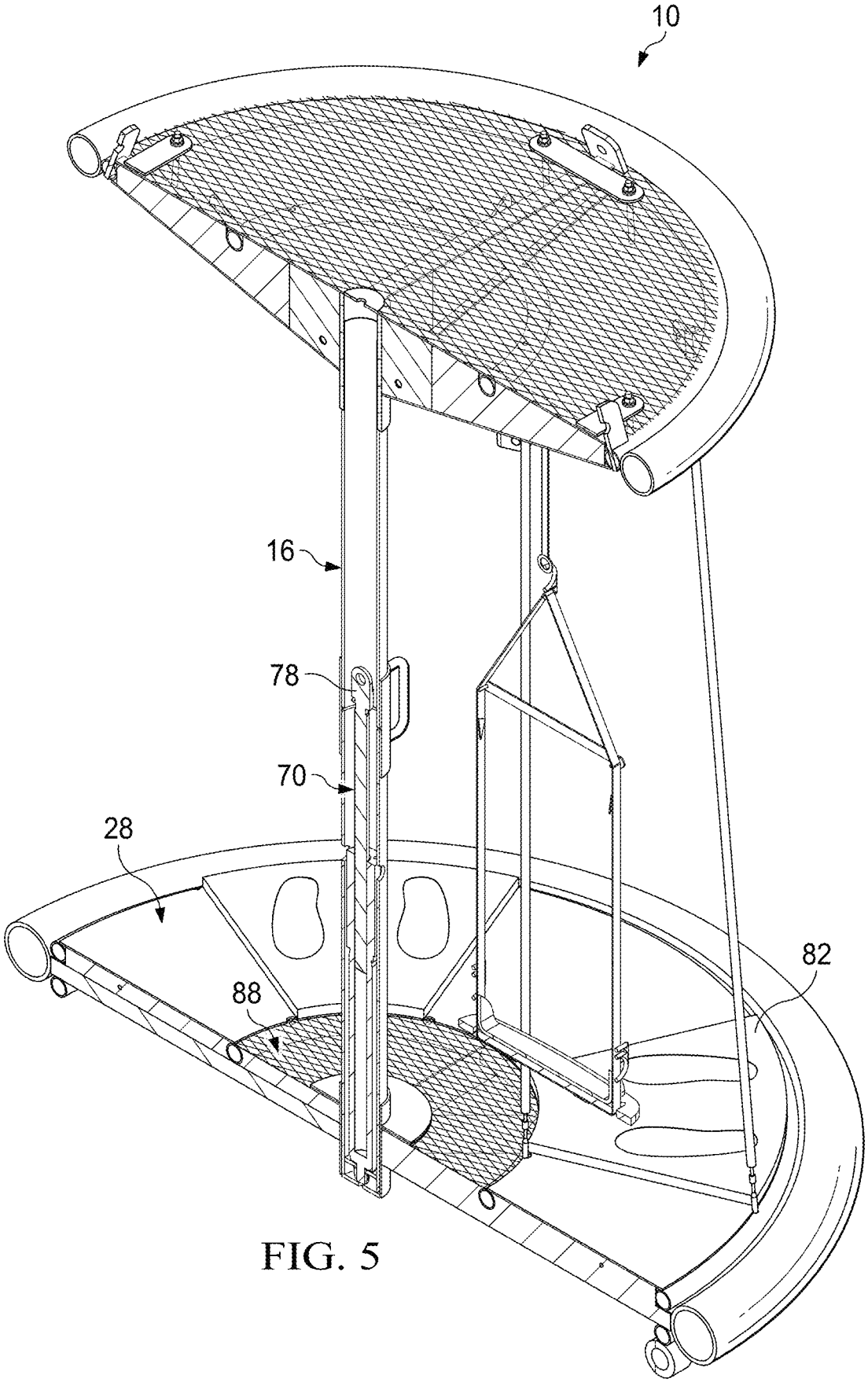
FIG. 5 illustrates a sectional perspective view of a personnel transfer device including a passive heave compensator, in accordance with some embodiments.
Figure 6:
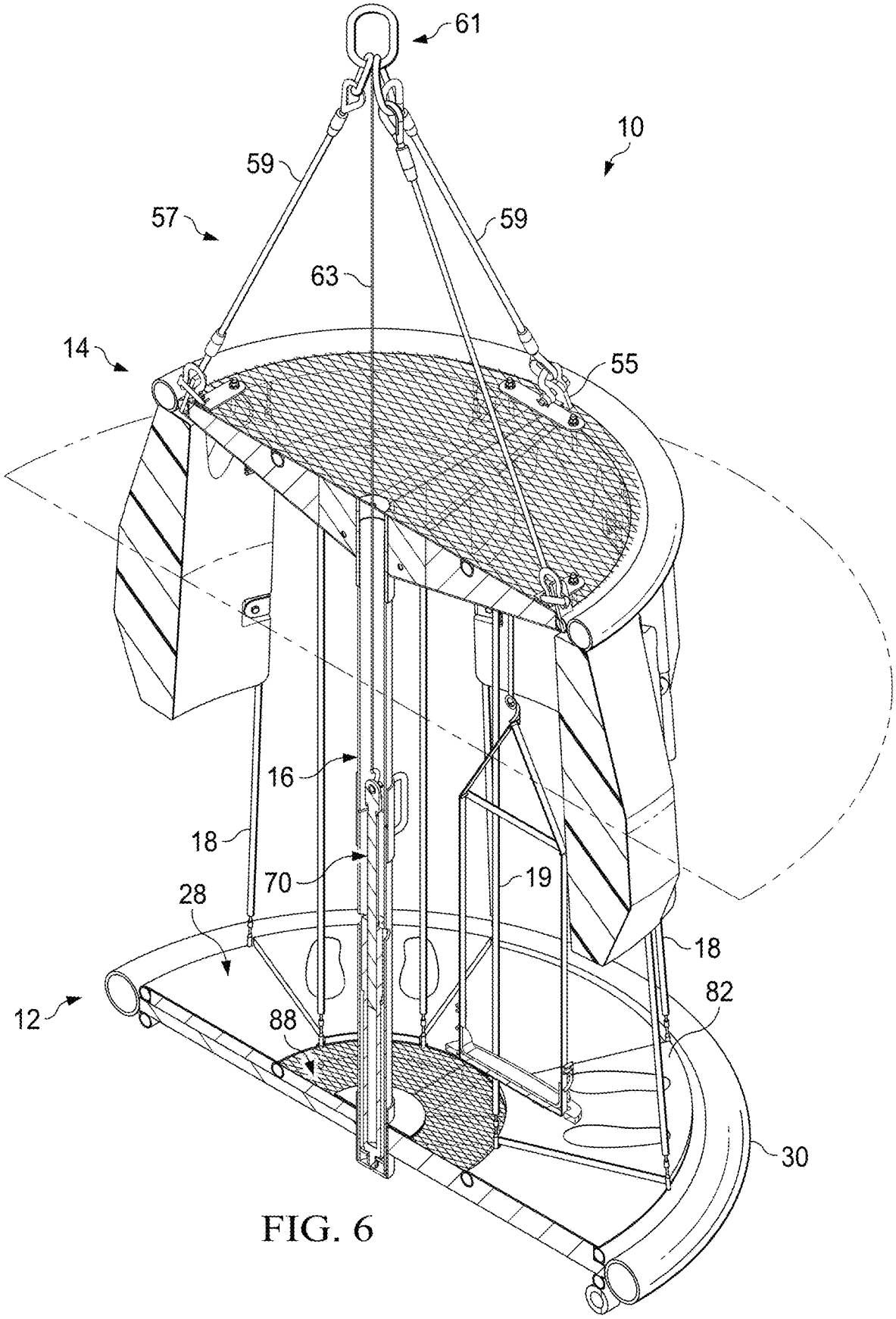
FIG. 6 illustrates a sectional perspective view of a personnel transfer device including a passive heave compensator and an upper sling set, in accordance with some embodiments.
Figure 7:
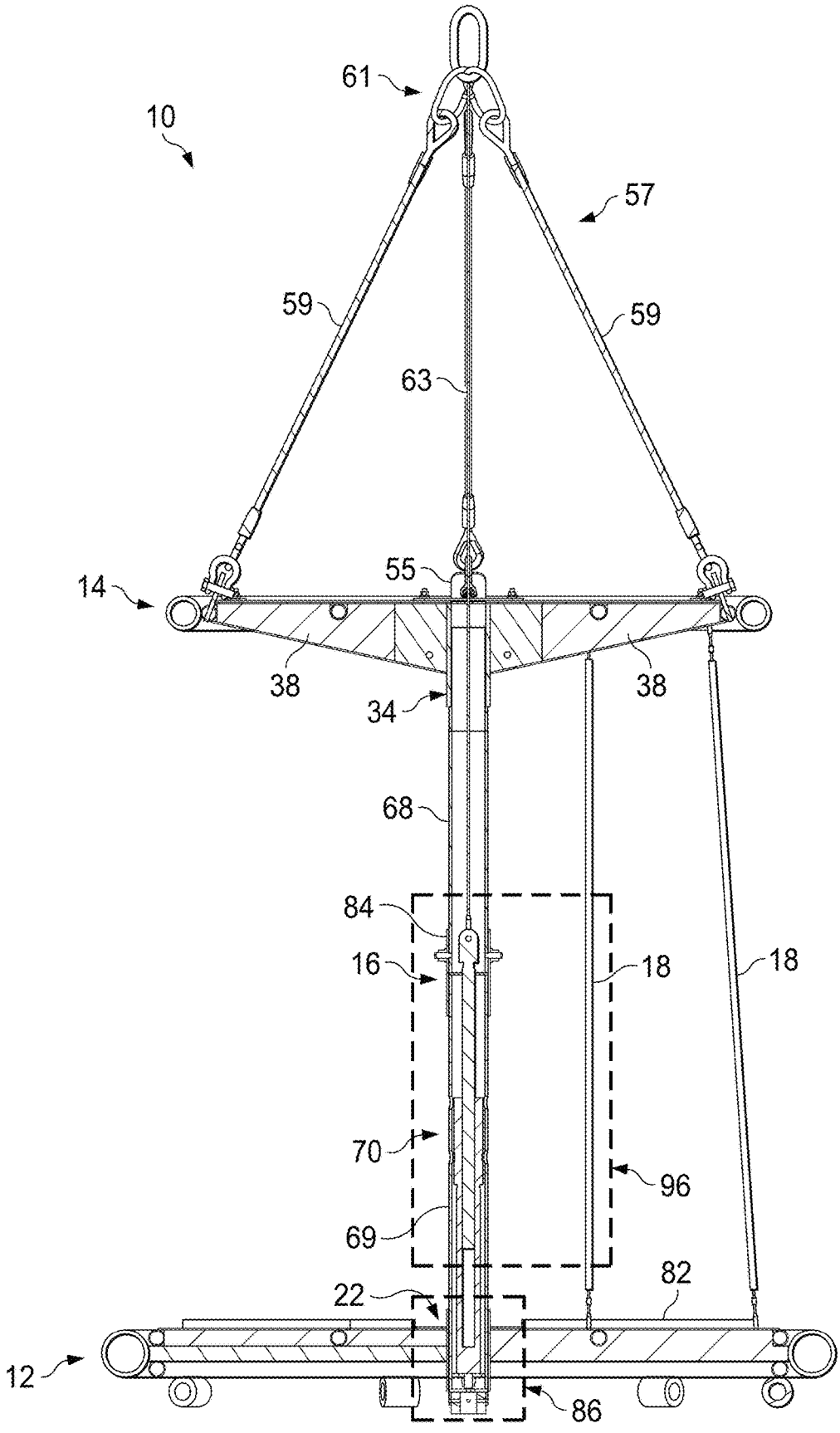
FIG. 7 illustrates a cross-section view of a personnel transfer device along a plane substantially parallel to plane A-A' in FIG. 1 and including a passive heave compensator and an upper sling set, in accordance with some embodiments.
Figure 8:
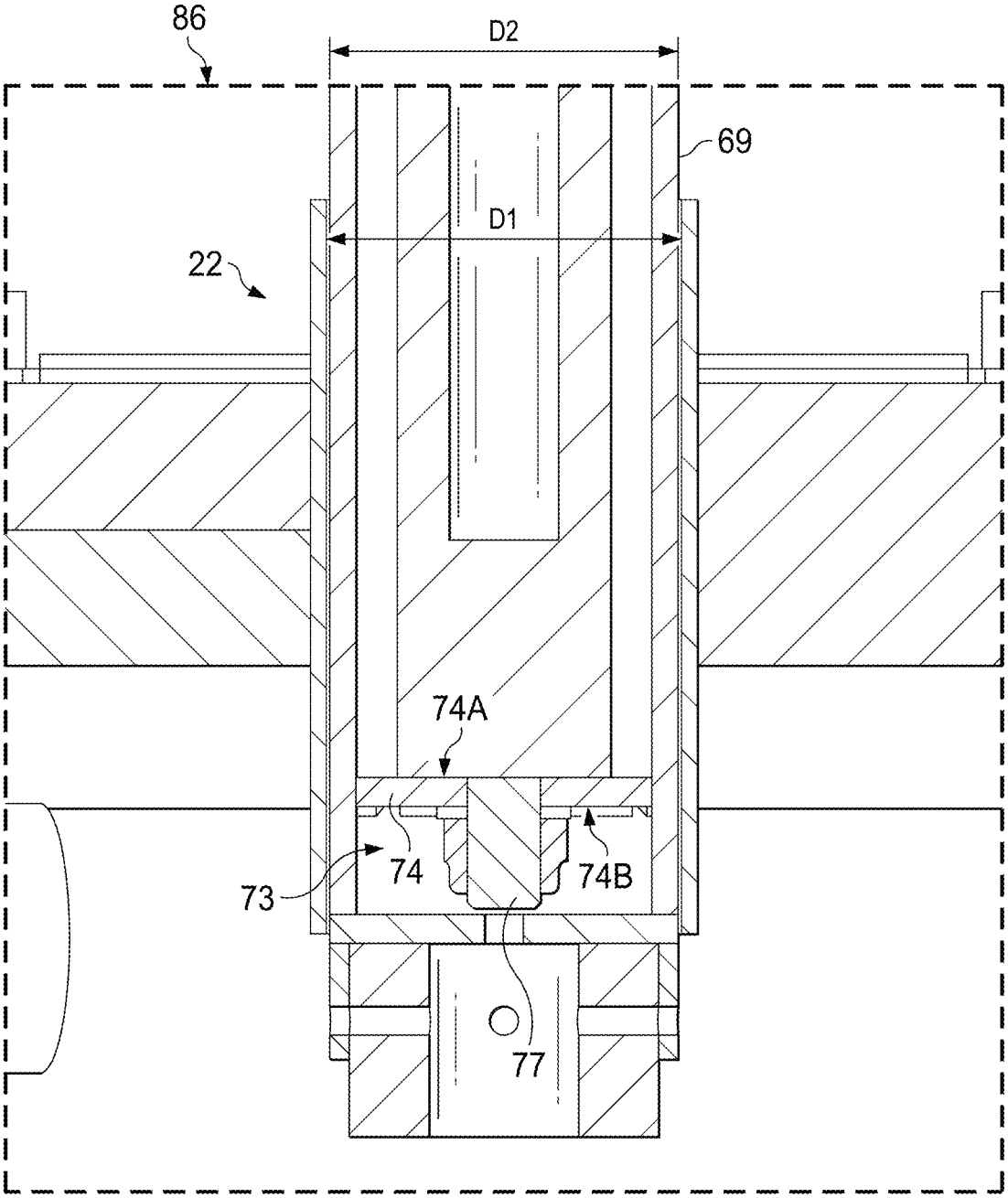
FIG. 8 illustrates a cropped cross-section view of a coupler and lower portion of a support column and passive heave compensator, in accordance with some embodiments.
Figure 9:
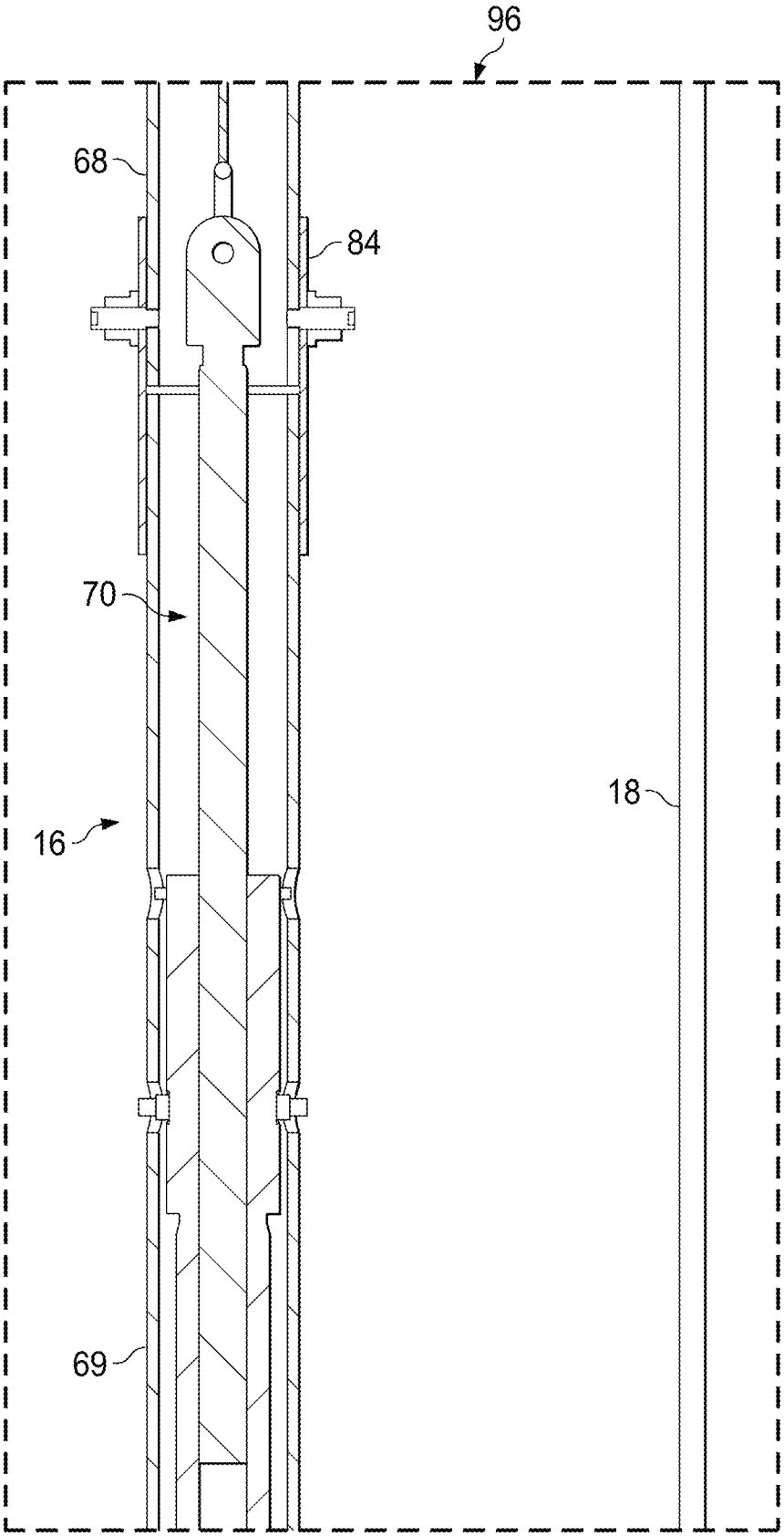
FIG. 9 illustrates a cropped cross-section view of a support column including the passive heave compensator, in accordance with some embodiments.
Figure 10:
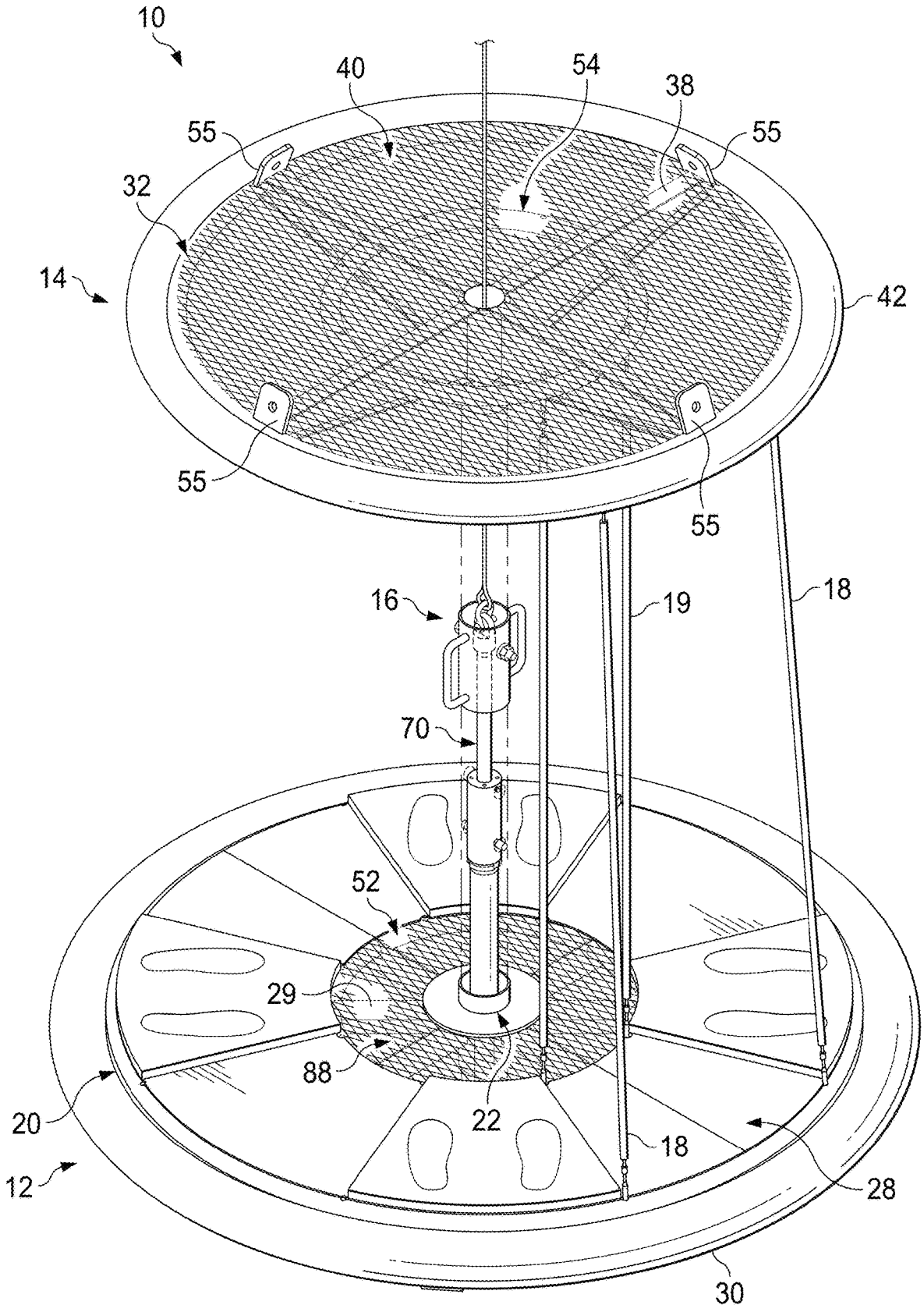
FIG. 10 illustrates a further perspective view of a personnel transfer device including a passive heave compensator, in accordance with some embodiments.
Figure 11:
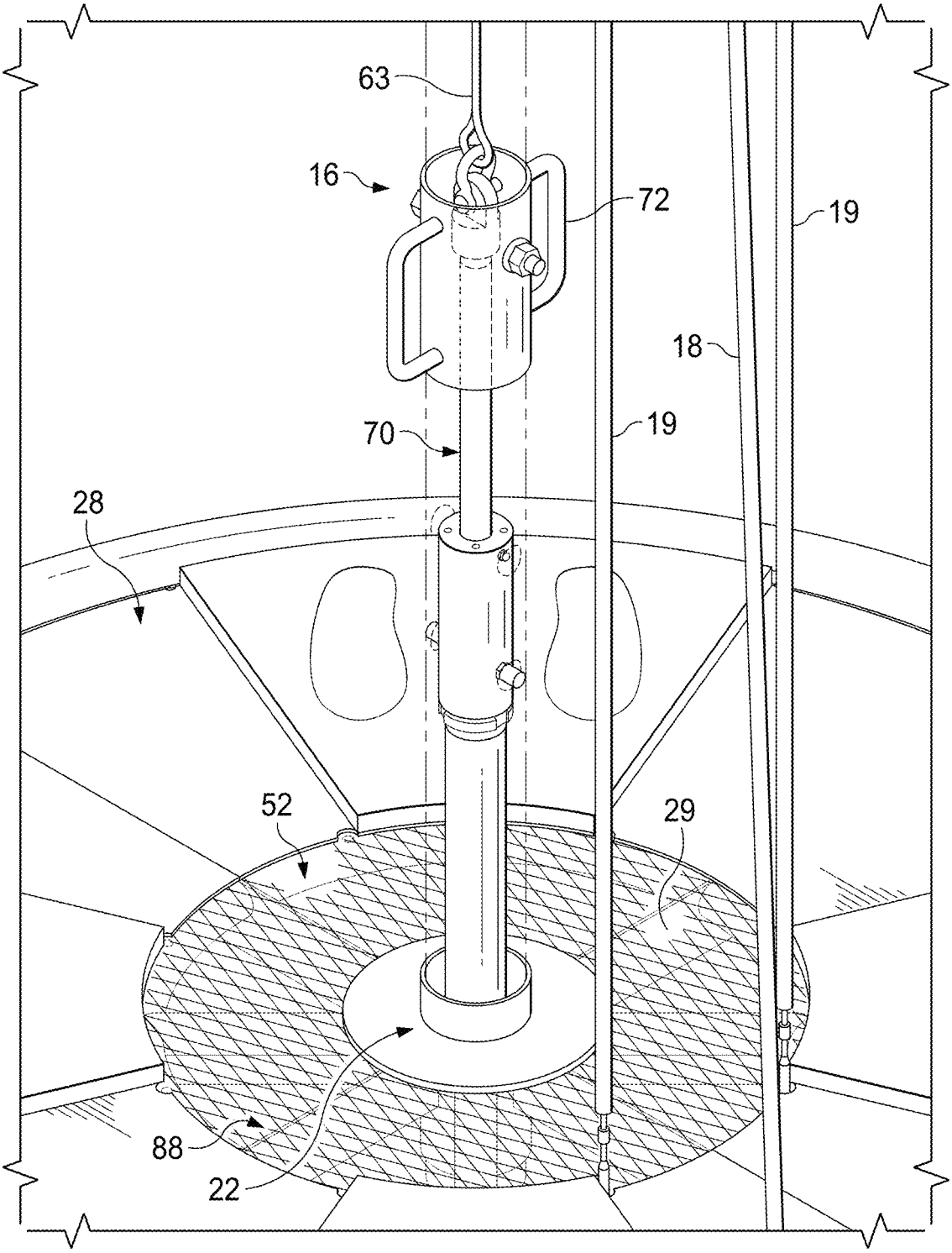
FIG. 11 illustrates another cropped perspective view of a portion of a personnel transfer device including a passive heave compensator, in accordance with some embodiments.
Figure 12A:
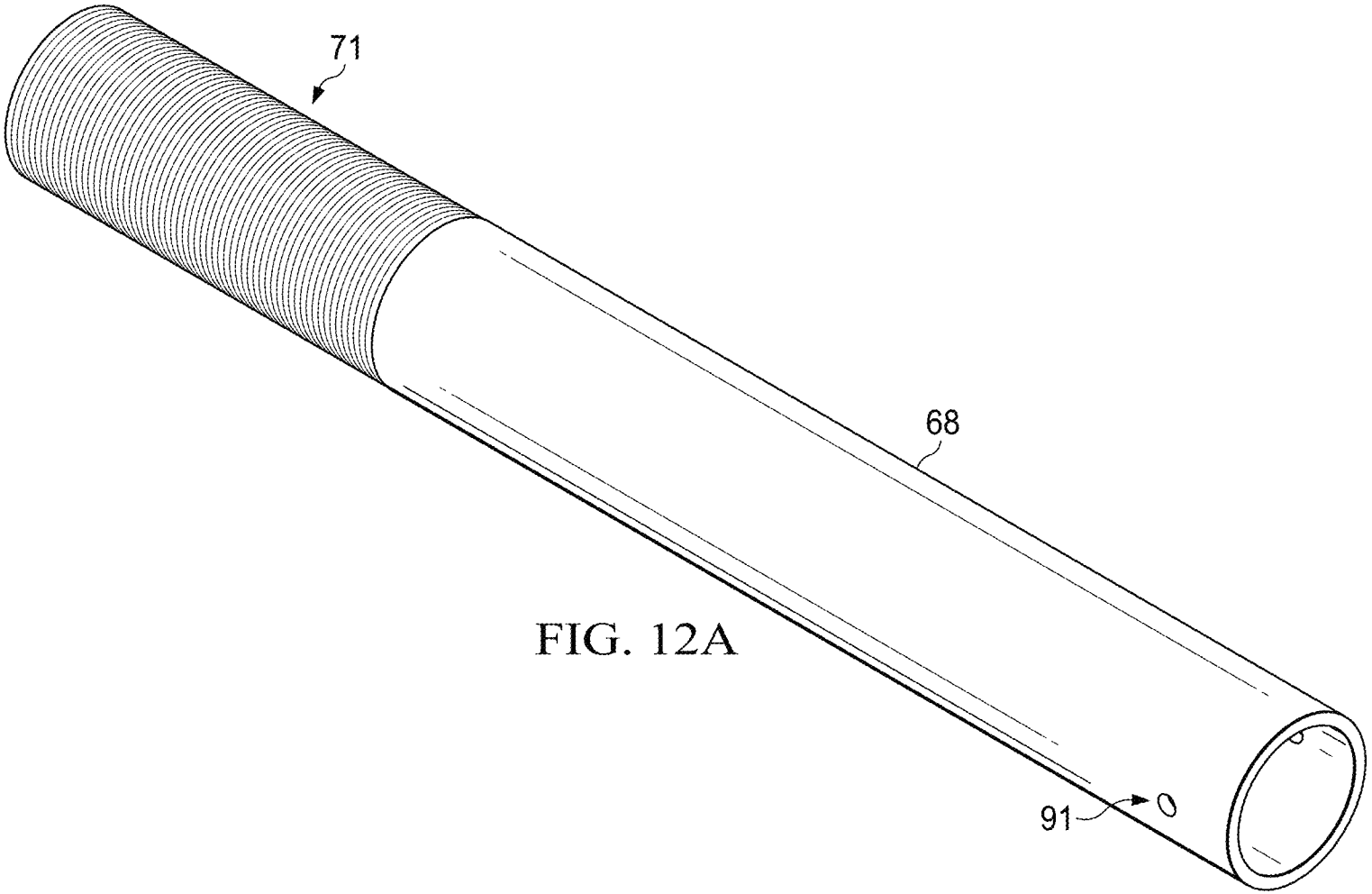
FIG. 12A illustrates a first exemplary upper portion of a support column, in accordance with some embodiments.
Figure 12B:
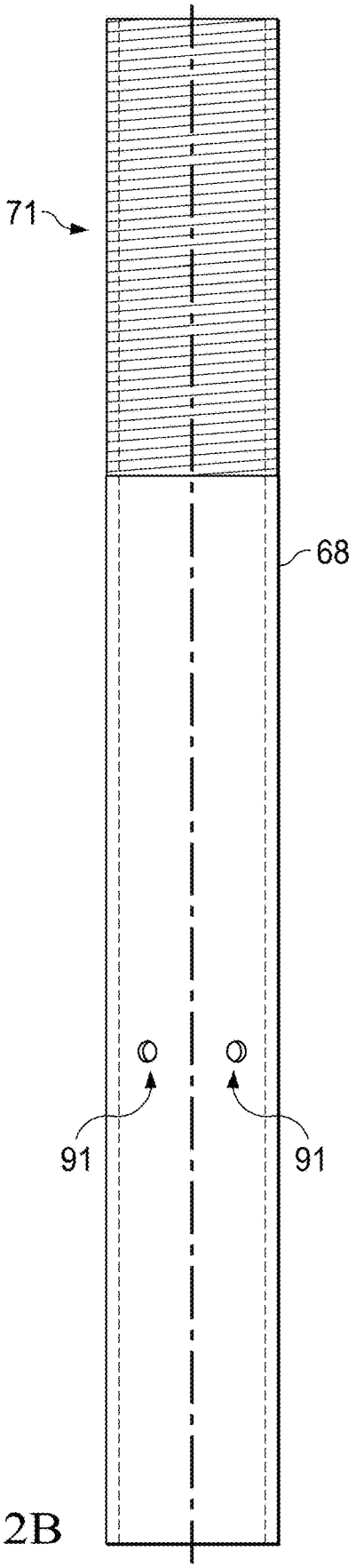
FIG. 12B illustrates a second exemplary upper portion of a support column, in accordance with some embodiments.
Figure 13A:
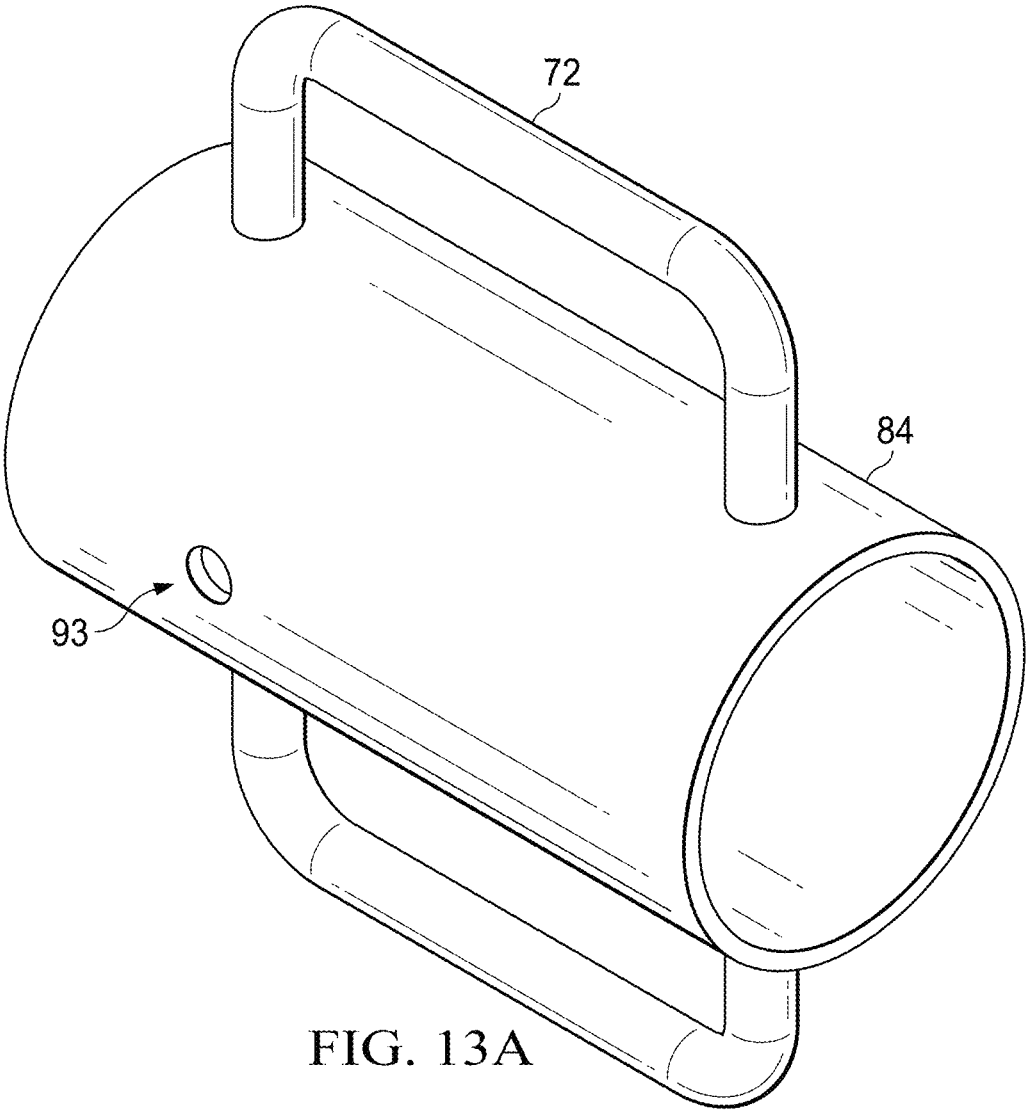
FIG. 13A illustrates a first exemplary intermediate coupler, in accordance with some embodiments.
Figure 13B:
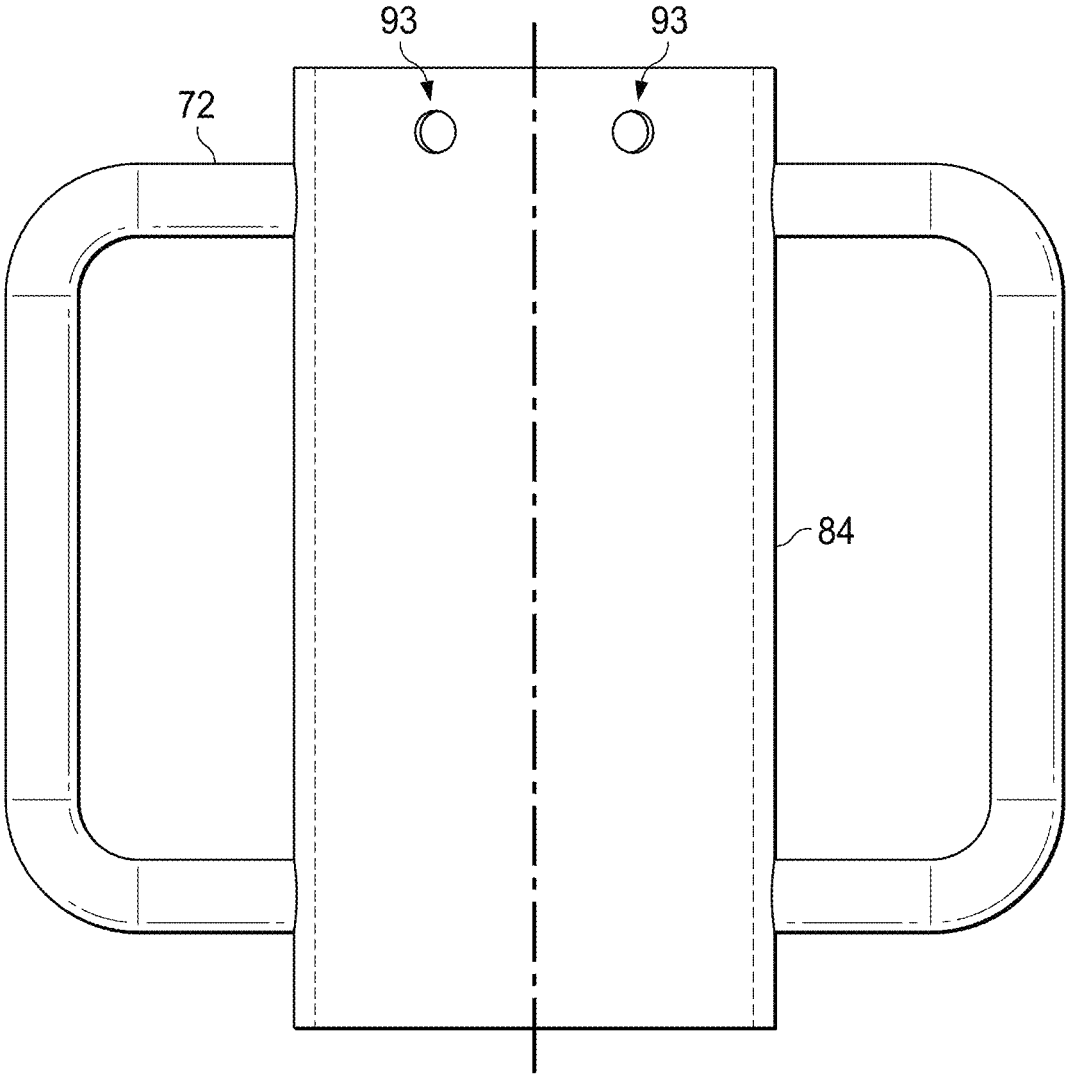
FIG. 13B illustrates a second exemplary intermediate coupler, in accordance with some embodiments.
Figure 14A:
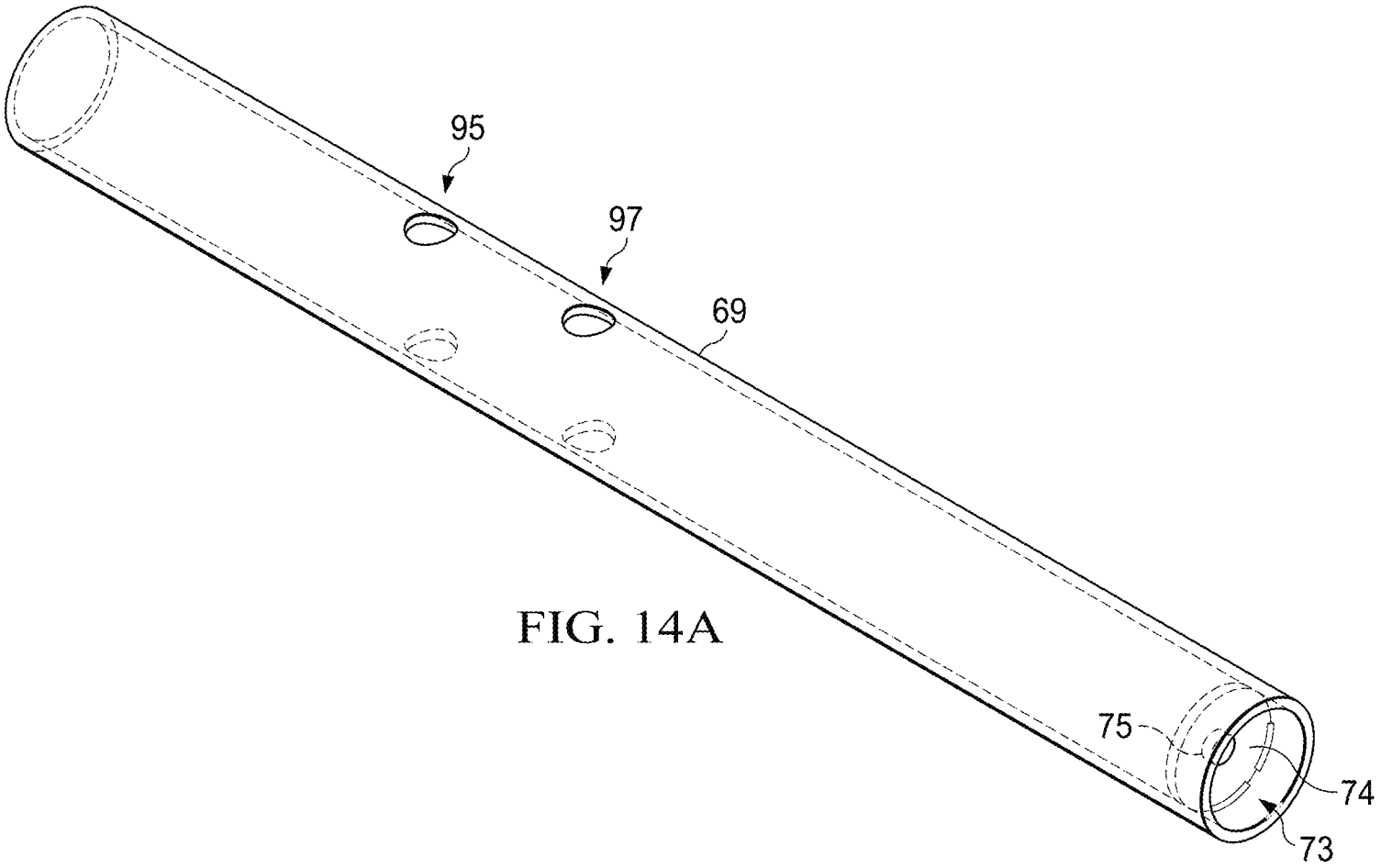
FIG. 14A illustrates a first exemplary lower portion of a support column, in accordance with some embodiments.
Figure 14B:
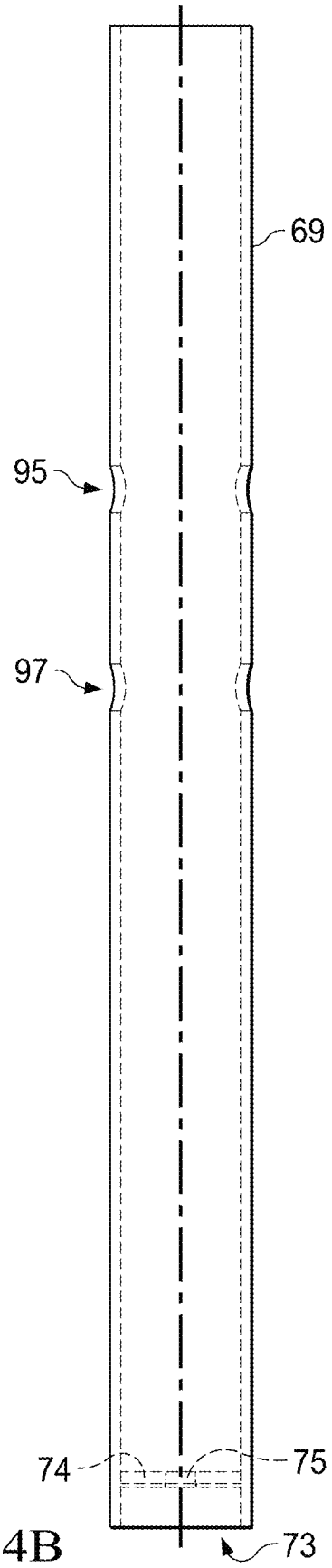
FIG. 14B illustrates a second exemplary lower portion of a support column, in accordance with some embodiments.
Figure 15:
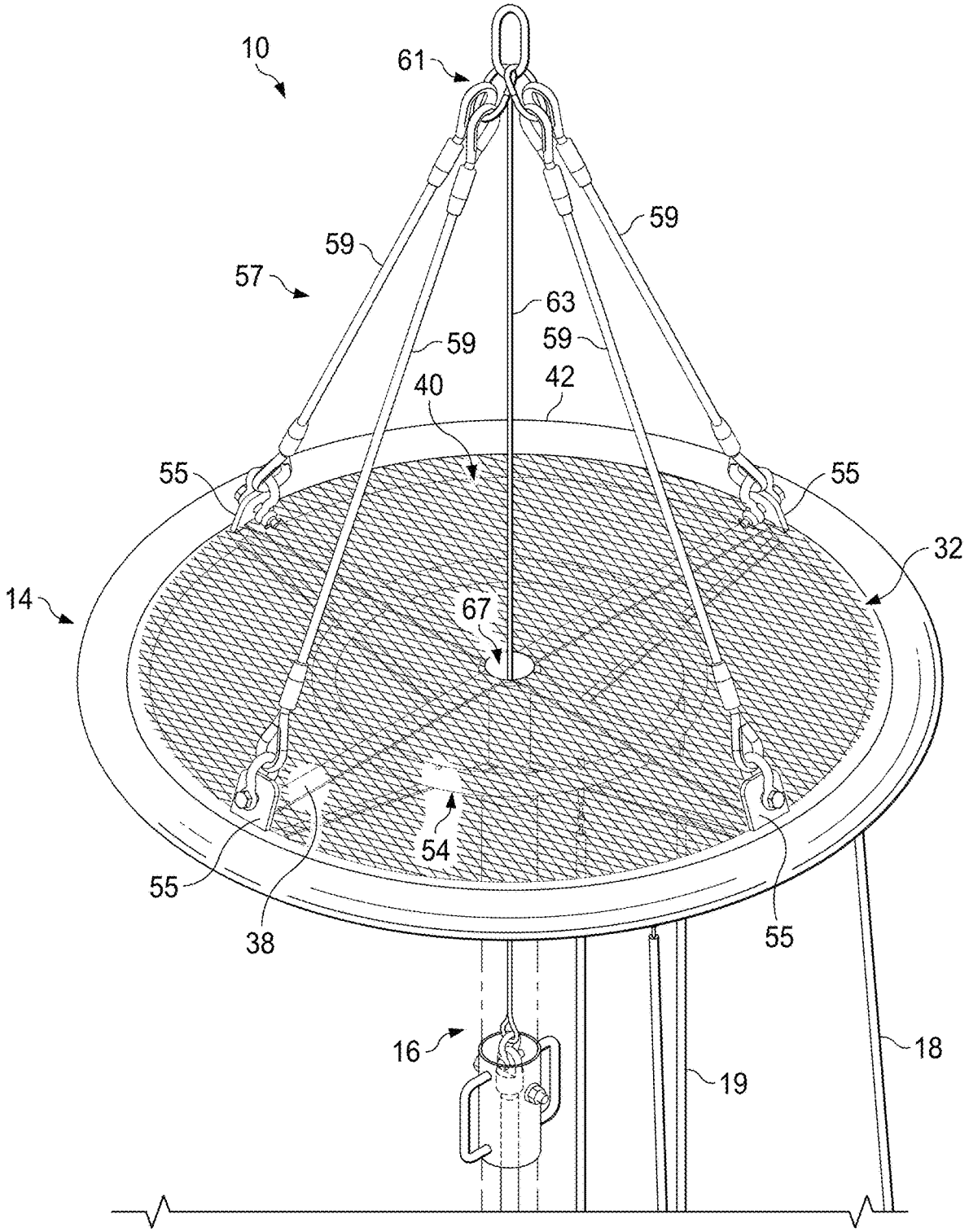
FIG. 15 illustrates a perspective view of an upper portion of a personnel transfer device including an upper sling set, in accordance with some embodiments.
Figure 16:
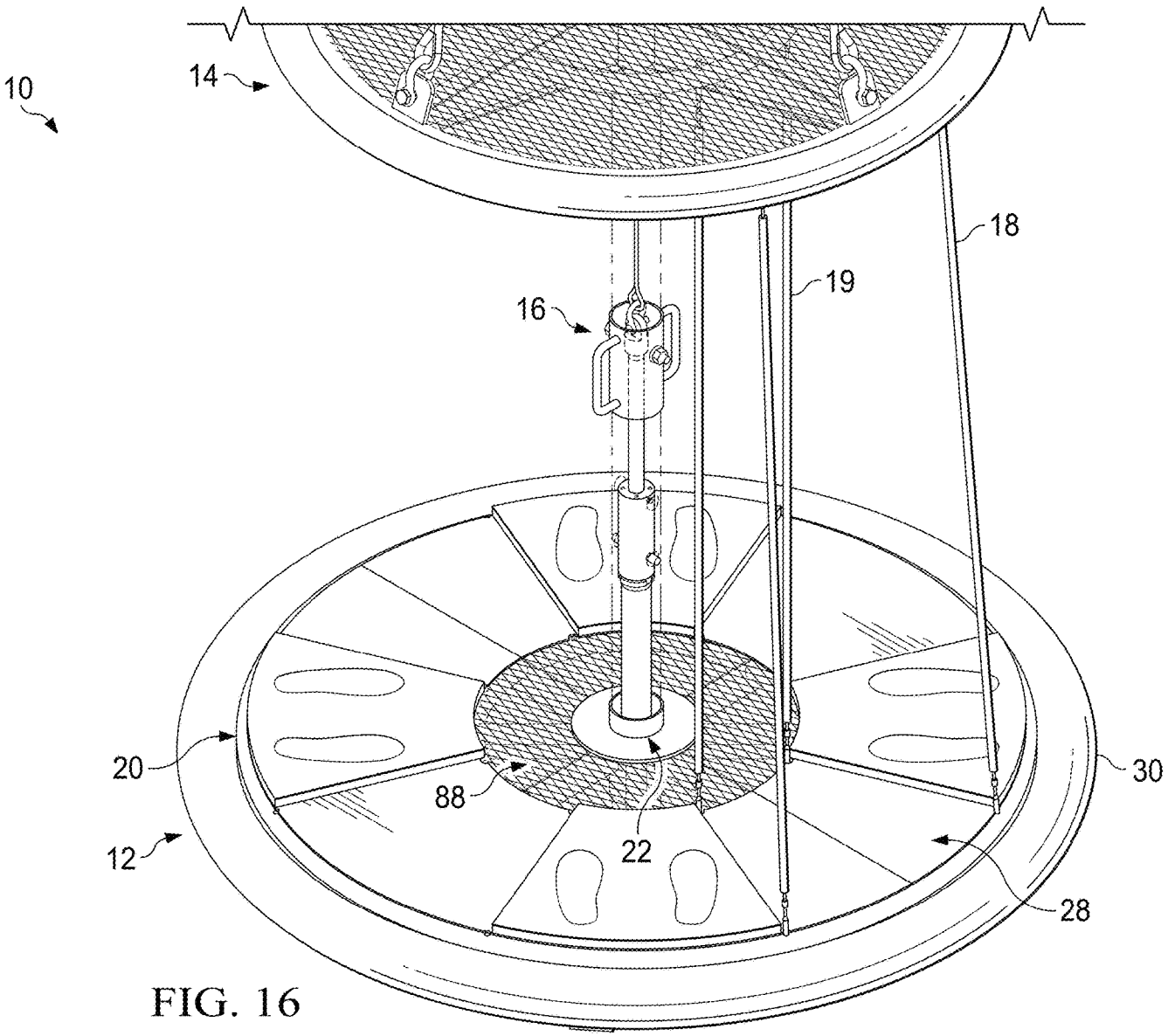
FIG. 16 illustrates still another cropped perspective view of a personnel transfer device including a passive heave compensator, in accordance with some embodiments.
Figure 17:
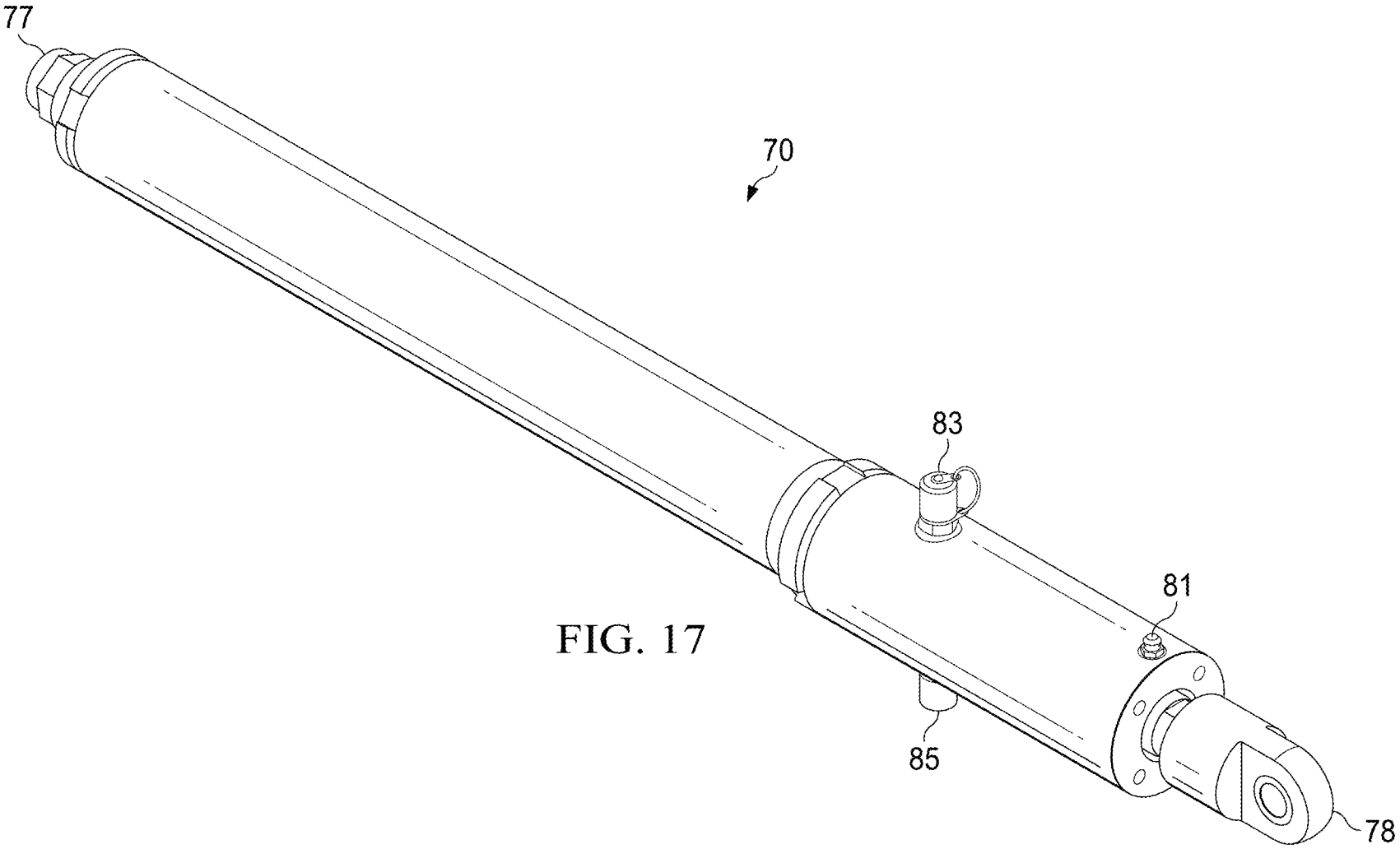
FIGS. 17, 18A, and 18B provide various views of an exemplary passive heave compensator, in accordance with some embodiments.
Figure 18A:
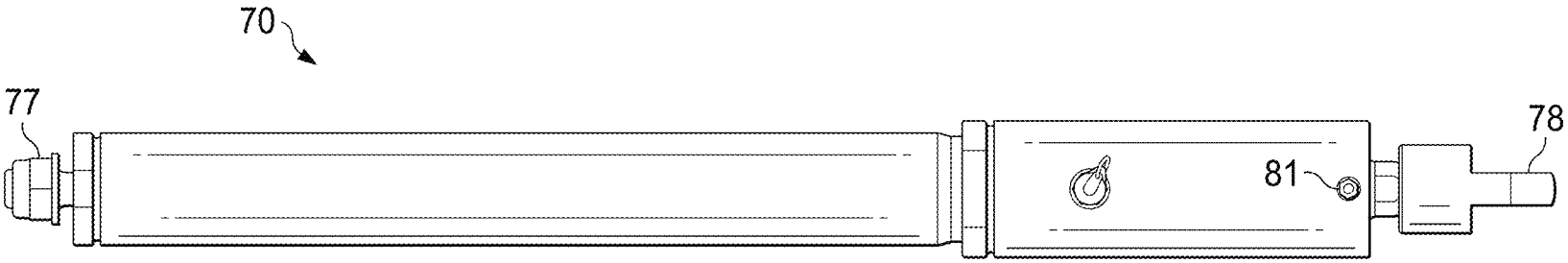
Figure 18B:
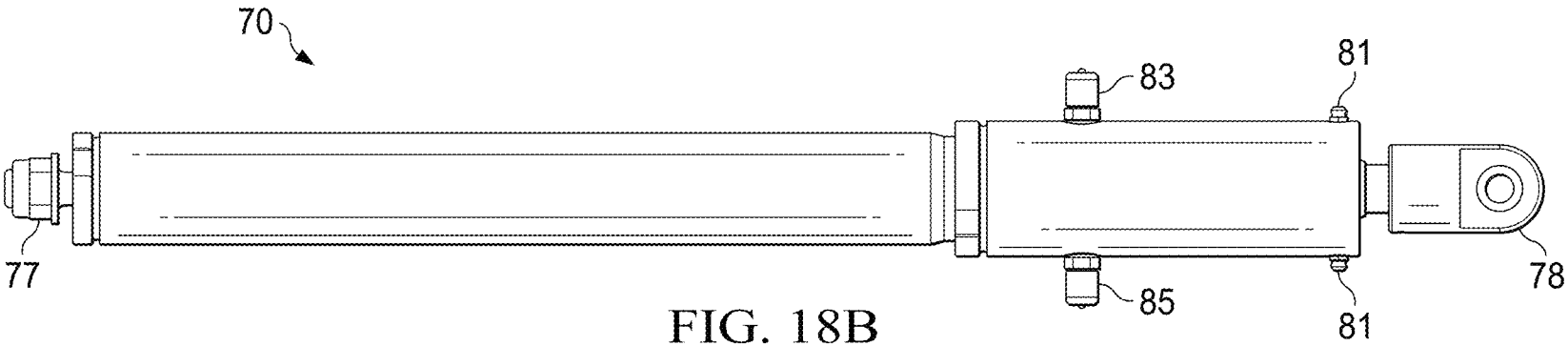
Figure 19:
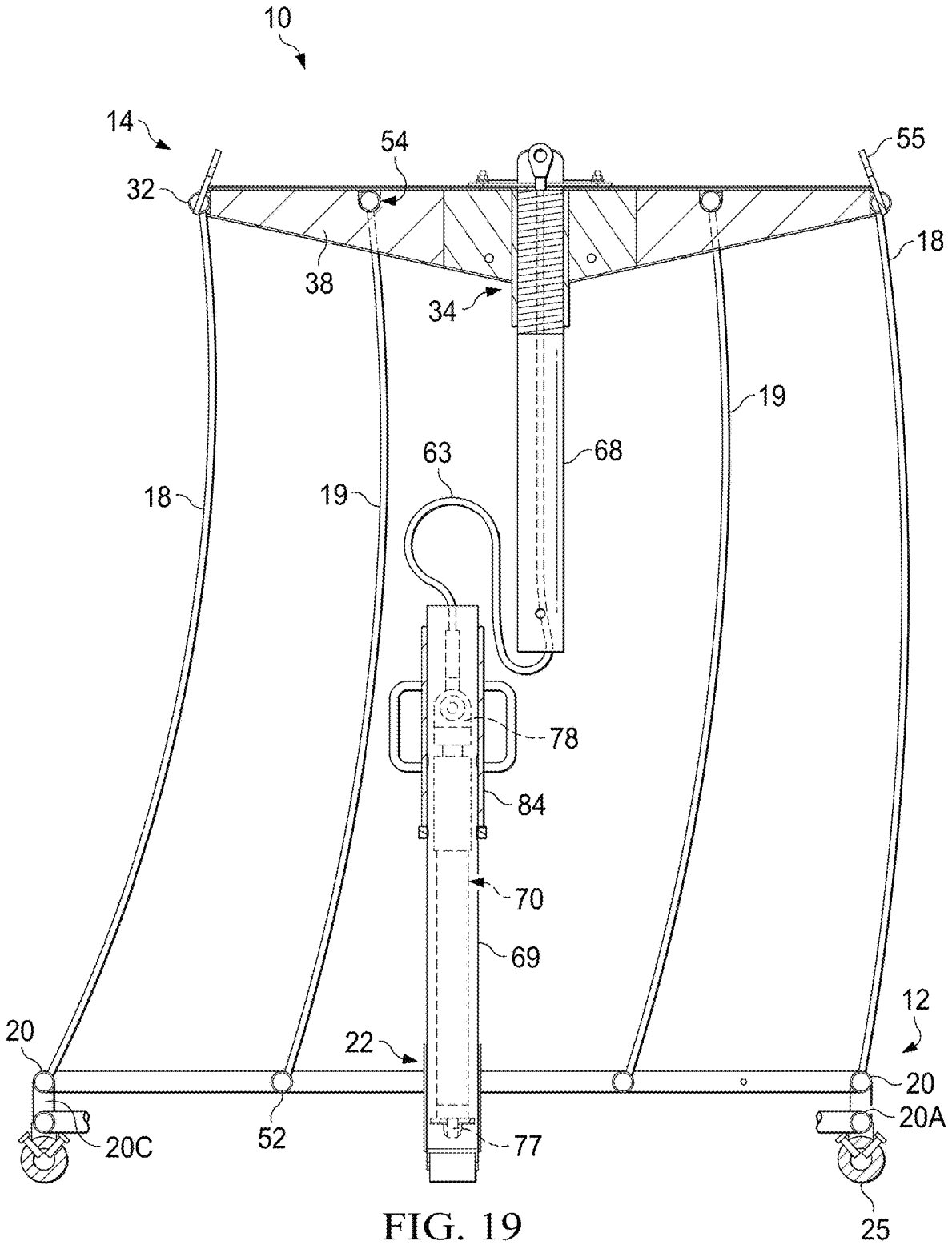
FIG. 19 illustrates a cross-section view of a partially disassembled personnel transfer device along a plane substantially parallel to plane A-A' in FIG. 1 and including a passive heave compensator, in accordance with some embodiments.

The disclosed personnel transfer device is discussed, in part, with reference to FIGS. 1-11, 12A/12B, 13A/13B, 14A/14B, and 15-19, which illustrate various embodiments, views, sections, portions of, or components of, an exemplary personnel transfer device 10, in accordance with embodiments of the present disclosure. FIG. 1 illustrates a perspective view of the personnel transfer device 10, in accordance with some embodiments; FIG. 2 illustrates a side view of the personnel transfer device 10, in accordance with some embodiments; FIG. 3 illustrates another perspective view of the personnel transfer device 10, in accordance with some embodiments; FIG. 4 illustrates a cropped perspective view of a portion of the personnel transfer device 10 including a passive heave compensator (PHC) 70, in accordance with some embodiments; FIG. 5 illustrates a sectional perspective view of the personnel transfer device 10 including the PHC 70, in accordance with some embodiments; FIG. 6 illustrates a sectional perspective view of the personnel transfer device 10 including the PHC 70 and an upper sling set 57 for lifting the personnel transfer device 10, in accordance with some embodiments; FIG. 7 illustrates a cross-section view of the personnel transfer device 10 along the plane substantially parallel to plane A-A' in FIG. 1 and including the PHC 70 and the upper sling set 57, in accordance with some embodiments; FIG. 8 illustrates a cropped cross-section view of a coupler 22 and lower portion 69 of a support column 16 and the PHC 70, which includes a zoomed-in view of a portion 86 of the cross-section view of FIG. 7, in accordance with some embodiments; FIG. 9 illustrates a cropped cross-section view of the support column 16 including the PHC 70, which includes a zoomed-in view of a portion 96 of the cross-section view of FIG. 7, in accordance with some embodiments; FIG. 10 illustrates a further perspective view of the personnel transfer device 10 including the PHC 70, in accordance with some embodiments; FIG. 11 illustrates another cropped perspective view of a portion of the personnel transfer device 10 including the PHC 70, in accordance with some embodiments; FIG. 12A illustrates a first exemplary upper portion 68 of the support column 16, in accordance with some embodiments; FIG. 12B illustrates a second exemplary upper portion 68 of the support column 16, in accordance with some embodiments; FIG. 13A illustrates a first exemplary intermediate coupler 84, in accordance with some embodiments; FIG. 13B illustrates a second exemplary intermediate coupler 84, in accordance with some embodiments; FIG. 14A illustrates a first exemplary lower portion 69 of the support column 16, in accordance with some embodiments; FIG. 14B illustrates a second exemplary lower portion 69 of the support column 16, in accordance with some embodiments; FIG. 15 illustrates a perspective view of an upper portion of the personnel transfer device 10 including the upper sling set 57, in accordance with some embodiments; FIG. 16 illustrates still another cropped perspective view of the personnel transfer device 10 including the PHC 70, in accordance with some embodiments; FIGS. 17, 18A, and 18B provide various views of an exemplary passive heave compensator that may be used to implement the PHC 70, in accordance with some embodiments; and FIG. 19 illustrates a cross-section view of a partially disassembled personnel transfer device 10 along the plane substantially parallel to plane A-A' in FIG. 1 and including the PHC 70, in accordance with some embodiments.

Referring first to FIGS. 1-3, 7, and 10, the personnel transfer device 10 includes a base 12 (or frame bottom 12) spaced apart from a top 14 (or frame top 14) by a support column 16 that is coupled to each of the base 12 and the top 14. In some embodiments, a plurality of cables 18 extend between the base 12 and the top 14. The cables 18 may be flexible when relaxed and become substantially rigid when tension is applied. By way of example, the tension in the cables 18 is supplied by the support column 16, which expands the space between the base 12 and the top 14 to apply tension to the cables 18. In some cases, the cables 18 (or the cables 19, described below) may be referred to as grab line cables.

In accordance with various examples, the support column 16 is sufficiently strong to impart a rigid connection between the base 12 and the top 14 and to impart significant tension to the cables 18. In some embodiments, the personnel transfer device 10 may be fabricated using a durable aluminum skeleton structure. Thus, in some examples, the support column 16 may be constructed of aluminum. In addition, the base 12 and the top 14, or portions thereof, may also be constructed of aluminum, in some cases. To be sure, in other embodiments, an alternative material of sufficient strength and durability may be used instead of, or in addition to, aluminum to provide one or more of the support column 16, the base, and the top 14. The support column 16 may also be disassembled and removed, in some examples, to allow the top 14 and the base 12 to be collapsed together for convenient storage, as well as for convenient and cost-effective shipping, without removing the cables 18.

In some embodiments, the base 12 may include a base spreader ring 20 supporting a coupler 22 (or coupling 22). In an embodiment the base spreader ring 20 has a circular shape with a diameter sufficiently large (e.g., about 5' to 7' Dia.) to allow personnel to be carried thereon. The coupler 22 is supported centrally located with respect to the base spreader ring 20, for example, by support structures 29 that radially extend at least partially between the coupler 22 and the base spreader ring 20 (e.g., along an underside of the base 12). As shown in the illustrated examples, a platform 28 is also provided extending at least partially between the base spreader ring 20 and the coupler 22 to permit personnel to stand on the platform 28. In various examples, the platform 28 may also be supported by the support structures 29 radially extending between the coupler 22 and the base spreader ring 20 (e.g., along the underside of the base 12). Like the support column 16, and in some examples, the base spreader ring 20, the coupler 22, and the support structures 29 may be constructed of aluminum. In some cases, the platform 28 may be constructed of a lightweight sheet material having a non-slip surface, such as diamond plate or expanded-metal grating. In some embodiments, the base spreader ring 20 may be surrounded and/or covered with a padding 30, which may provide cushioning to protect the personnel transfer device 10 from inadvertent side impact. The padding 30 may be fastened to the base spreader ring 20 and covered with a durable protective covering. In some cases, the durable protective covering may directly surround and/or cover the base spreader ring 20 without the padding 30. Whether or not the padding 30 is used, the padding 30 and protective cover are not configured to provide buoyancy. Stated another way, the padding 30 and the protective cover are non-buoyant.

In some embodiments, the top 14 may include a top spreader ring 32 supporting a coupler 34 (or coupling 34), as shown in FIGS. 7 and 19. In an embodiment, the top spreader ring 32 has a circular shape with a diameter (e.g., about 4' to 6' Dia.) that is less than or equal to the diameter of the base spreader ring 20. As a result, and in various embodiments, the cables 18 may be slightly angled inward (from bottom-to-top) between the base 12 and the top 14, or the cables may be substantially vertical between the base 12 and the top 14, when the cables 18 are placed in tension. The coupler 34 is supported centrally located with respect to the top spreader ring 32, for example, by support structures 38 that radially extend at least partially between the coupler 34 and the top spreader ring 32 (e.g., along an underside of the top 14). In some embodiments, a roof 40 is also provided extending at least partially between the top spreader ring 32 and the coupler 34 to allow personnel standing on the base 12 to have protection from above when standing on the platform 28. In some embodiments, the roof 40 may also be supported by the support structures 38 (e.g., disposed along the underside of the top 14). In some examples, the top spreader ring 32 may be surrounded and/or covered with a padding 42 attached to the top spreader ring 32 and covered with a durable protective covering. In some cases, the durable protective covering may directly surround and/or cover the top spreader ring 32 without the padding 42. Whether or not the padding 42 is used, the padding 42 and protective cover are not configured to provide buoyancy. Stated another way, the padding 42 and the protective cover are non-buoyant.

In the illustrated examples, the cables 18 are shown attached between the base 12 and the top 14. In an exemplary embodiment, the cables 18 are positioned evenly spaced apart, with an outer set of cables 18, attached at or near the periphery of the base 12 and at or near the periphery of the top 14. In various embodiments, the cables 18 comprise flexible cords, lines, ropes, wire ropes, cable or like material having high strength and a low amount of stretch when placed in tension. In some embodiments, the cables 18 may be securely fastened to the base spreader ring 20 and the top spreader ring 32. At least the outer set of the plurality of cables 18 are provided, in some implementations. In some embodiments, lengths of each cable 18 of the outer set of cables 18 are substantially equal, between the corresponding base attachment (at the base 12) and the top attachment (at the top 14) so that the base 12 and top 14 will be substantially parallel to each other when the plurality of cables 18 are placed in tension.

In some cases, the cables 18 may include wire rope such as a Warrington-Scale (WS) wire rope. In various embodiments, the cables 18 may include stainless steel halyard lines. In some embodiments, the cables 18 attached at the periphery of the base 12 and the top 14 will become taut and therefore substantially "rigid" when the cables 18 are placed in tension and thereby form a barrier against side impact. In some alternative embodiments, the cables 18 may include a high strength non-stretch cable. For instance, in some cases, the cables 18 may be constructed from a high strength multi-stranded fiber, material, such as AMSTEEL® twelve strand, 9/16-inch, diameter, high molecular weight polyethylene (12 s, 9/16", HMWPE) available from Samson Rope Company (rated as having an average strength of 30,800 lbs). In still other embodiments, the cables 18 may be constructed of successive layers of polyurethane, fiberglass resin, and/or polypropylene rope.

In addition to the outer set of cables 18, and in an exemplary embodiment, an inner set of the cables 19 may be provided attached between the base 12 and the top 14. In some embodiments, the inner set of cables 19 are attached at the base 12 and at the top 14 spaced inside of the peripheries of the base 12 and the top 14. For example, the inner set of cables 19 may be attached between the coupler 22 and the base spreader ring 20, and between the coupler 34 and the top spreader ring 32. In some embodiments, lengths of the inner set of cables 19 may be equal to, slightly less than, or slightly greater than the lengths of the outer set of cables 18. In a construction where all of the cables 18, 19 are of substantially equal length, the inner set of cables 19 will become taut, under tension created by the support column 16 expanding the distance between the base 12 and the top 14, when the outer set of cables 18 become taut. In some cases, for example such as when the lengths of the inner set of cables 19 is slightly less than the lengths of the outer set of cables 18, the inner set of cables 19 may be place under some tension, when the outer set of cables 18 become taut and rigid. Thus, with the tension in the inner set of cables 19 either equal to or less that the tension in the outer set of cables 18, the inner set of cables 19 are useful for providing hand gripping away from the periphery and vertical support for the personnel on board the personnel transfer device 10. In the event of inadvertent impact from the outside, as by a bobbing boat deck or an inadvertent action by a hoist operator, any onboard personnel will be shielded by the taut outer set of cables 18 from such side impact.

For ease of construction and for strength and durability of the personnel transfer device 10, the base 12 may further include a base inner ring 52 (e.g., See FIGS. 10-11). concentric with the base spreader ring 20 (which may also be referred to as the base outer ring 20) and supported by the radially extending support structures 29 that extend at least partially between the coupler 22 and the base spreader ring 20. Similarly, the top 14 may be constructed with a top inner ring 54 (e.g., See FIGS. 10 and 15) concentric with the top spreader ring 32 (which may also be referred to as the top outer ring 32) supported by support structures 38 that radially extend at least partially between the coupler 34 and the top spreader ring 32. In such an exemplary embodiment of the personnel transfer device 10, the outer set of cables 18 may be attached to the base outer ring 20 and the top outer ring 32, and the inner set of the cables 19 may be attached to the base inner ring 52 and top inner ring 54.

In some embodiments, the support column 16 when assembled is coupled to the base 12 at the base coupler 22 and is coupled to the top 14 at the top coupler 34. In an exemplary embodiment, at least one of the base coupler 22 and the top coupler 34 is provided with threads. In some cases, the top coupler 34 is provided with threads. In various example, matching threads are also provided on a threaded portion of the support column 16 (either on an upper portion 68 or on a lower portion 69 of the support column 16). When the top coupler 34 is provided with threads, corresponding threads are provided on a threaded portion 71 of the upper portion 68 of the support column 16 (e.g., as illustrated in FIGS. 12A and 12B).

In some embodiments, the base coupler 22 has an inside diameter D1 slightly larger than, and configured for receiving, the outside diameter D2 of the lower portion 69 of the support column 16 (e.g., See FIG. 8). By way of example, the lower portion 69 of the support column 16 may be inserted within the base coupler 22, fitting closely therein, to provide coupling support to the support column 16. In some cases, the inside of the coupler 22 may also be provided with a closed end, for example to support the lower portion 69 of the support column 16. In some examples, the lower portion 69 of the support column 16 may be secured (e.g., to the base coupler 22) against rotation by a means for securing such as a bolt, pin, threaded stud and jam nut, or other means for securing through corresponding aligned openings. In some alternative embodiments, such a means for securing may not be used, thereby permitting relative rotation between the lower portion 69 of the support column 16 and the base coupler 22.

In some examples, the support column 16 further includes an intermediate coupler 84 (e.g., See FIGS. 4, 7, 9, 13A, 13B) for coupling the upper portion 68 and the lower portion 69 of the support column 16. In some embodiments, the intermediate coupler 84 may be secured to the upper portion 68 of the support column 16 with a means for securing such as a bolt, pin, threaded stud and jam nut, or other means for securing while also preventing relative rotation between, and/or decoupling of, the intermediate coupler 84 and the upper portion 68 of the support column 16. In some cases, the intermediate coupler 84 may also be secured to the lower portion 69 of the support column 16 with a means for securing such as a bolt, pin, threaded stud and jam nut, or other means for securing while also preventing relative rotation between, and/or decoupling of, the intermediate coupler 84 and the lower portion 69 of the support column 16. In some embodiments, handles 72 may also be rigidly affixed as by welding or otherwise to the intermediate coupler 84 (e.g., See also FIGS. 11, 13A, 13B).

As shown in the figures, the personnel transfer device 10 may be lifted using an upper sling set 57 (e.g., See FIGS. 6, 7, 15) coupled to lift points 55 (e.g., See FIGS. 1, 2, 6, 7, 10, 15, 19) disposed along a top portion of the top spreader ring 32. The lift points 55 may include plates with a radiused (or rounded) upper portion including a radiused lifting lug or padeye. In some embodiments, the upper sling set 57 may be designed as a symmetric matched pair (e.g., including four identical slings 59 of equal length, with two slings per sub link of a master link assembly 61). The upper sling set 57 may thus be equivalently referred to as a 4-leg sling with a master link assembly. In various embodiments, the upper sling set 57 is designed with a nominal angle from vertical (e.g., such as about 30°) for each leg (e.g., for each of the four identical slings 59). By way of example, the upper sling set 57 may be used to lift the personnel transfer device 10, together with a sling 63 (e.g., See FIGS. 6, 7, 11, 15, 19) attached to a passive heave compensator (PHC) 70 and the master link assembly 61, as described in more detail below, for example using a crane, hoist, or other lifting machine coupled to the master link assembly 61.

As previously noted, and apart from other features already described above, embodiments of the personnel transfer device 10 disclosed herein provide various other integrated safety features to enhance the safety of offshore personnel transfer. For example, various embodiments of the personnel transfer device 10 may include self-righting floatation, passive heave compensation (e.g., to provide softer pickups and takeoffs), softer cushioned landings, enhanced side impact protection, emergency seating, a floor grating for improved viewing (e.g., by onboard personnel) during landing, or combinations thereof. Each of these integrated safety features will now be discussed, for instance, in view of the description of the personnel transfer device 10, provided above.

With respect to the provided self-righting floatation, and with reference to FIGS. 1-3, the personnel transfer device 10 further includes floatation modules 60. In some examples, four floatation modules 60 are provided. However, in other embodiments, more or less than four flotation modules 60 may be provided. Each of the floatation modules 60, in some examples, has a volume of approximately 2 cubic feet. Thus, in embodiments including four floatation modules 60, a total volume of the four floatation modules 60 is approximately 8 cubic feet. In some embodiments, each of the floatation modules 60 is coupled (e.g., bolted, clipped, clamped, or otherwise attached) to an upper portion of a pair of adjacent cables 18. For example, a first lateral end 60A of a given floatation module 60 may be attached to the upper portion of a first cable 18 of the pair of adjacent cables 18, and a second lateral end 60B of the given floatation module 60 may be attached to the upper portion of a second cable 18 of the pair of adjacent cables 18. In some alternative embodiments, narrower floatation modules (e.g., having a smaller width that the illustrated floatation modules 60) may be used, where such narrower floatation modules are coupled (e.g., bolted, clipped, clamped, or otherwise attached) to an upper portion of a respective one of the cables 18 and to a portion of the top 14. In some cases, each of the narrower floatation modules will have a lesser volume than the illustrated floatation modules 60. However, in embodiments including the narrower floatation modules, a greater number of the narrower floatation modules will be used (e.g., as compared to the four floatation modules 60 shown in the illustrated examples) such that a total volume of the narrower floatation modules will be around 8 cubic feet, similar to the total volume for the four floatation modules 60. Regardless of the particular implementation of the floatation modules (e.g., the floatation modules 60 or the narrower floatation modules), the floatation modules are configured in such a way so as not to impede egress of personnel riding on the personnel transfer device 10.

By attaching the floatation modules 60 (or narrower floatation modules) to the upper portion of the cables 18, the floatation modules 60 (or narrower floatation modules) are biased upward with respect to the cables 18 (and more generally with respect to the personnel transfer device 10). In some embodiments, by biasing the floatation modules 60 (or narrower floatation modules) upward, a center of gravity of the personnel transfer device 10 will be disposed below a center of buoyancy of the personnel transfer device 10. Further, by biasing the floatation modules 60 (or narrower floatation modules) upward, the base 12 of the personnel transfer device 10 (and a lower part of the personnel transfer device 10) will sink into a body of water, with at least the center of gravity being below a water line 62 (e.g., See FIGS. 2-3). In some embodiments, and as shown, the water line 62 may be positioned near a center of each of the floatation modules 60 (or the narrower floatation modules, in alternative embodiments). Stated another way, about half of each of the floatation modules 60 (or narrower floatation modules) may be below the water line 62, while the other half is above the water line 62. Having the center of gravity below the center of buoyancy will ensure that the personnel transfer device 10 floats upright, and more generally, provides for self-righting floatation of the personnel transfer device 10. In some examples, the floatation modules 60 (or alternatively the narrower floatation modules) also thus provide the personnel transfer device 10 with enough stability to handle the rigging (by which the personnel transfer device 10 is lifted) luffing to one side.

In various examples, personnel standing on the platform 28 will be neutrally buoyant. Further, in some cases, personnel standing on the platform 28 will have at least 24 inches of head height between a bottom surface of the top 14 and the water line 62. Also, in addition to providing buoyancy and self-righting floatation, the floatation modules 60 (or alternatively the narrower floatation modules) are configured to provide enhanced protection from inadvertent side impacts. Additionally, by attaching the floatation modules 60 to the upper portion of the cables 18, an opening 64 may be provided beneath each floatation module 60 and between the adjacent pair of cables 18 to which the floatation module 60 is attached. In some embodiments, the opening 64 may extend from a bottom surface of the floatation module 60 to a top surface of the base 12. In addition to floor grating, as described further below, the opening 64 may provide for improved viewing (e.g., by personnel) during transport and landing of the personnel transfer device 10. In various embodiments, the opening 64 may also be configured to permit wind to pass therethrough, and more generally to permit wind to pass through the personnel transfer device 10, during personnel transfer. Thus, the opening 64 provided beneath each floatation module 60 helps to limit an available surface area for wind to catch when the personnel transfer device 10 is in use (e.g., transferring personnel). It is also noted that regardless of the particular implementation of the floatation modules, a means of egress (an opening between adjacent ones of the cables 18) of sufficient width is provided for personnel standing on the platform 28. For example, in various embodiments and regardless of the particular implementation of the floatation modules, an egress width (as measured between adjacent cables 18 or between lateral edges of adjacent floatation modules) of at least 500 mm is provided to ensure a quick and safe option for riders to exit the personnel transfer device 10.

With respect to the provided passive heave compensation, and with reference to FIGS. 4-11, the personnel transfer device 10 further includes a heave compensator 70. In some examples, the heave compensator 70 includes the PHC 70, discussed above. The PHC 70 is used to dampen the shock of dynamic loads on a hoisting system (e.g., a crane lifting the personnel transfer device 10). Stated another way, the PHC 70 is used to store dynamic energy (e.g., such as from waves or other dynamic energy source) which would otherwise influence the payload (e.g., such as the personnel transfer device 10) and safely dissipate the energy later. In general, the PHC 70 may include a spring-damper system constructed using a hydraulic cylinder, piston, and a charged accumulator. In some embodiments, the hydraulic cylinder is filled with hydraulic oil, while the charged accumulator is filled with nitrogen. In some cases, the PHC 70 is nitrogen charged only, and does not use hydraulic fluid (e.g., hydraulic oil). In operation, a payload is attached to an end of the PHC 70 causing the piston to extend. As the piston extends, the nitrogen gas in the accumulator will be compressed by the motion of the piston and in turn increase the pressure acting upon the piston. The stiffness of the PHC 70 is proportional to the pressure of the nitrogen gas in the accumulator, which may vary with the motion of the piston. For purposes of this disclosure, the motion of the piston may be referred to as a stroke (e.g., back and forth motion along the axis of the PHC 70), and a "stroke out" of the PHC 70 may refer to full extension of the piston (e.g., which may occur upon lifting a payload, such as the personnel transfer device 10). The overall effect of the PHC 70 is thus to isolate the payload (e.g., the personnel transfer device 10) from dynamic forces and/or shock that would otherwise impact the payload, thereby providing a softer take-off upon lifting of the personnel transfer device 10 (e.g., such as by a crane).

In some embodiments, and as shown in the figures, the PHC 70 may be disposed within an interior portion of the support column 16, integrated within the support column 16, or more generally disposed coaxially with respect to the support column 16. In some cases, the PHC 70 may be coupled to the base 12 (e.g., such as in FIGS. 4-6). In other examples, the PHC 70 may be coupled to a portion of the support column 16 itself (e.g., such as in FIGS. 7-11). It may be advantageous, in some examples, to position the PHC 70 as close to the base 12 as possible (e.g., center of mass of the PHC 70 disposed within the lower portion 69 of a support column 16) in order to ensure that the center of gravity remains below the center of buoyancy of the personnel transfer device 10. In addition, by positioning the load of the PHC 70 as close to the base 12 as possible, stability of the lift of the personnel transfer device 10 during personnel transfers is improved.

In various embodiments, a first end of the PHC 70 (e.g., a lower portion of the PHC 70) is coupled to the support column 16, in some cases to the lower portion 69 of the support column 16 near the base 12. Further, in an example, a second end of the PHC 70 (e.g., an upper portion of the PHC 70) is configured for attachment of a sling 63 (e.g., See FIGS. 6, 7, 11, 15, 19) for coupling the PHC 70 to the master link assembly 61 (e.g., See FIGS. 7, 15) for lifting of the personnel transfer device 10 (e.g., in concert with the upper sling set 57). As shown, the sling 63 extends upward (and in some cases substantially vertically) from the second end of the PHC 70 through the support column 16, out of an opening 67 at the roof 40 (e.g., See FIG. 15), which may include a corresponding opening at a top end of the upper portion 68 of the support column 16, and couples to the master link assembly 61. In some cases, and due to the position of the PHC 70 within the support column 16, a length of the sling 63 may be greater than the length of each of the slings 59 used to form the upper sling set 57.

It will be appreciated that when the personnel transfer device 10 is lifted (e.g., by a crane, hoist, or other lifting machine coupled to the master link assembly 61), dynamic forces are at play. As merely some examples, such dynamic forces may be a result of load application or load release that can be caused by any of a number of factors such as lifting or landing the personnel transfer device 10, blowing wind, abrupt starts/stops, shuddering of the crane during a lift or move, sling breakage, collisions, as well as other factors and/or scenarios. As one exemplary scenario, when a crane lifts the load (e.g., the personnel transfer device 10), the PHC 70 will stroke out until the upper sling set 57 becomes tight (taut), which will dampen the effect of dynamic forces acting on the personnel transfer device 10 and provide for a softer take-off and lift-off from the deck of a boat and/or from offshore drilling or production platforms.

It is noted that the primary or main load path, for lifting the personnel transfer device 10, will remain as the upper sling set 57 (4-leg sling) and the master link assembly 61. However, when a lift of the personnel transfer device 10 is initiated, and in accordance with embodiments of the present disclosure, the sling 63 attached to the second end of the PHC 70 will engage before the upper sling set 57 engages and becomes taut under the load. Thus, in some cases, the sling 63 may also be referred to as an initially engaging sling portion, and the upper sling set 57 may be referred to as a later engaging sling portion. More particularly, and in various embodiments, it is the engagement and stroking of the sling 63 (and thus the PHC 70) that dampens the dynamic forces acting on the load (e.g., the personnel transfer device 10).

While the PHC 70 has been described as being coupled to the base 12 or to the lower portion 69 of the support column 16 itself, in other embodiments, the PHC 70 may be coupled to the upper portion 68 of the support column 16, while remaining disposed coaxially with respect to the support column 16. In still other embodiments, the PHC 70 may not be directly coupled to the support column 16 and instead may be disposed between the master link assembly 61 and a top surface of the roof 40, while still being disposed coaxially with respect to the support column 16. Thus, in such alternative embodiments, the length of the sling 63 may be substantially equal to or less than the length of each of the slings 59 which are used to form the upper sling set 57. Regardless of the exact vertical position of the PHC 70 (e.g., along an axis spanning a distance between the master link assembly 61 and the lower portion 69 of the support column 16 or the base coupler 22), when a lift of the personnel transfer device 10 is initiated and as discussed above, the sling 63 attached to the second end of the PHC 70 will engage before the upper sling set 57 engages and becomes taut under the load, thereby damping the dynamic forces acting on the load.

It is also noted that the vertical position of the PHC 70, for example depending on where it is coupled, may modulate the center of gravity of the personnel transfer device 10 (e.g., a higher vertical position of the PHC 70 will result in a higher center of gravity as compared to a lower vertical position of the PHC 70). In general, and as previously discussed, it may be advantageous to ensure that the center of gravity remains below the center of buoyancy to ensure that the personnel transfer device 10 floats upright (e.g., maintains self-righting floatation). In some cases, a size, shape, position, and/or number of floatation modules 60 may be modified to change the center of buoyancy, for example as the center of gravity changes in correspondence with varying the vertical position of the PHC 70, in order to maintain the self-righting floatation of the personnel transfer device 10 (e.g., by keeping the center of gravity below the center of buoyancy).

Elaborating on the coupling of the PHC 70 to the support column 16, reference is made to FIG. 8. As shown, and in some embodiments, the lower portion 69 of the support column 16 may have a recess 73, defined in part by a plate 74 having an opening 75 (the opening 75 more clearly visible in FIG. 14A), which is used to couple the first end of the PHC 70 to the lower portion 69 of the support column 16. As shown in FIG. 8, the first end of the PHC 70 may be disposed on (or rest on) a top side 74A of the plate 74. In some embodiments, a mounting stud 77 (or mounting nut 77, or mounting screw 77) is positioned along a bottom side 74B of the plate 74 such that an engaging portion (e.g., a screw portion) of the mounting stud 77 passes through the opening 75 to engage with (couple to) a corresponding receiving portion in the first end of the PHC 70 to secure the PHC 70 to the support column 16, while a head portion of the mounting stud 77 remains engaged with the bottom side 74B of the plate 74. In various examples, a depth of the recess 73 may be greater than or equal to a height of the head portion of the mounting stud 77, such that the mounting stud 77 is fully disposed within the recess 73. In another embodiment, the first end of the PHC 70 may include a threaded stud that extends from the first end of the PHC 70 through the opening 75. In such an embodiment, the mounting stud 77 includes a mounting nut 77 that threads onto (or engages) the threaded stud extending from the first end of the PHC 70 to secure the PHC 70 to the support column 16.

For purposes of illustration, FIGS. 17, 18A, and 18B provide various views of an exemplary passive heave compensator that may be used to implement the PHC 70, in accordance with some embodiments. As shown, a mounting nut 77 is positioned at a first end of the PHC 70, and a second end of the PHC 70 includes a connection point 78 configured for attachment of the sling 63 for coupling the PHC 70 to the master link assembly 61 for lifting of the personnel transfer device 10. The PHC 70 may also include greasing points 81, a filling connection 83, and a pressure gauge connection 85, in some embodiments.

FIG. 19 shows a cross-section view of a partially disassembled personnel transfer device 10 including the PHC 70, illustrating further details of the personnel transfer device 10, in accordance with some embodiments. Similar to the discussion provided above, the personnel transfer device 10 shown in FIG. 19 includes the base 12, the top 14, the coupler 22 supporting the lower portion 69 of the support column 16, the coupler 34 threadedly coupled to the upper portion 68 of the support column 16, the intermediate coupler 84 installed over the lower portion 69 of the support column 16, the outer set of cables 18, the inner set of cables 19, and the lift points 55, among other features. Since the personnel transfer device 10 in the illustrated example is partially disassembled, the cables 18, 19 are shown as being slacked. The example of FIG. 19 also shows the outer set of cables 18 attached to the base outer ring 20 and the top outer ring 32, and the inner set of the cables 19 may be attached to the base inner ring 52 and top inner ring 54. In addition, the example of FIG. 19 more clearly depicts how the sling 63, which is coupled to the second end of the PHC 70, is threaded through the intermediate coupler 84 and the upper portion 68 of the support column 16 to extend out of the opening 67 at the roof 40. In some embodiments, as illustrated in FIG. 19, the base 12 may be constructed using two tubular rings (the base outer ring 20 and base ring 20A, a section of which is illustrated). In such embodiments, the rings 20, 20A may be secured parallel to each other and spaced a short distance from each other by a plurality of connector bars 20C positioned around and between the two rings 20, 20A. Additional views of this exemplary construction of the base 12 have also been provided in FIGS. 5, 6, and 7.

With respect to the provided emergency seating, and with reference to FIGS. 1-2, the personnel transfer device 10 may further include an emergency seat 80. While the personnel transfer device 10 is primarily designed for personnel to be transferred standing, in the event that someone cannot stand (e.g., due to injury or incapacitation), the emergency seat 80 may be optionally added when needed. In some examples, the emergency seat 80 may be suspended from the upper frame of the personnel transfer device 10 (e.g., such as from the support structures 38 that extend at least partially between the top spreader ring 32 and the coupler 34, or from another I-beam structural member) using a clamp (e.g., such as a scissor clamp). In some embodiments, the emergency seat 80 may include a bosuns chair, or variation thereof, that may be positioned above a luggage storage area of the personnel transfer device 10. In some cases, the emergency seat 80 may also include a harness or other fall prevention device. In operation, a rider seated in the emergency seat 80 may sit oriented perpendicular to a normal inward facing orientation (e.g., that is, the normal inward facing orientation for personnel standing on the personnel transfer device 10).

With respect to the provided softer cushioned landings, and with reference to FIGS. 1-7, the personnel transfer device 10 may further include cushioned landing pads 82 disposed at each location along the platform 28 where personnel may stand during transport. In some embodiments, each of the cushioned landing pads 82 may include an approximately 1-inch-thick layer of soft foam on which a rider may stand. The foam will help to provide a cushioning effect on the rider to soften their landing. In various cases, each of the cushioned landing pads 82 is equipped with a non-skid surface and is replaceable (e.g., when the cushioned landing pad 82 wears out). In some embodiments, the cushioned landing pads 82 may be affixed to the platform 28 (or more generally to the base 12) with hook and loop fasteners (e.g., such as industrial VELCRO®), or with another suitable fastener. Due to the varying nature of loads lifted during personnel transfers, it can be difficult for landing feet 25 (or shock absorbing feet 25) of the personnel transfer device 10 to accommodate the weight differential from one rider to up to four riders (or up to 6, 8, 10, or 12 riders, in some cases). Thus, by integrating the cushioned landing pads 82 onto the standing area (e.g., the platform 28) rather than on the landing feet of the personnel transfer device 10, each of the riders will be ensured to have a soft, cushioned landing regardless of the total number of riders on the personnel transfer device 10.

With respect to the provided floor grating for improved viewing during landing, and with reference to FIGS. 1, 3-6, 10-11, and 16, the personnel transfer device 10 may further include a section of expanded metal grated flooring 88. In some embodiments, the metal grated flooring 88 extends between the coupler 22 and the inner set of cables 19, or between the coupler 22 and an inner edge of the platform 28. As such, in some cases, the inner set of cables 19 may be substantially aligned with the inner edge of the platform 28. Further, in various examples, the metal grated flooring 88 may be concentric with, and between each of, the platform 28 and the support column 16. During lowering of the personnel transfer device 10, if a rider is not paying attention to the approaching deck, the rider can be caught off guard with an abrupt landing. The metal grated flooring 88 will provide the rider with a direct visual of the deck approaching the personnel transfer device 10 as it lands. This will enable the rider to be more prepared for the landing and can help to avoid injury. In addition, the viewing position provided by the metal grated flooring 88 will permit the rider to maintain their safe inward orientation while holding the grab lines (e.g., the inner set of cables 19) as the personnel transfer device 10 descends. Viewing below can thus be achieved by a simple glance downwards toward a rider's feet. As discussed above and in addition to the metal grated flooring 88, the opening 64 (provided beneath each floatation module 60 and between the adjacent pair of cables 18 to which the floatation module 60 is attached) may also provide for improved viewing (e.g., by riders) during landing of the personnel transfer device 10. It is also noted that in some cases, the grab lines may include (or be at least partially wrapped with) cushioned padding for improved rider comfort and safety.

Figure 20:
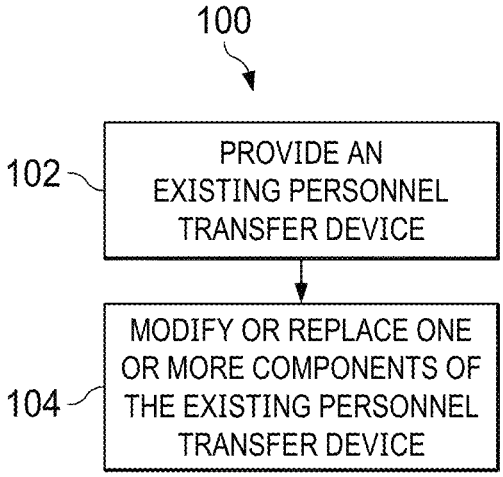
FIG. 20 provides a flow chart illustrating an embodiment of a method of retrofitting a personnel transfer device, in accordance with some embodiments.

In some embodiments, one or more of the features described herein may be retrofitted onto an existing personnel transfer device. Thus, referring now to FIG. 20, illustrated therein is a method 100 of retrofitting a personnel transfer device, in accordance with some embodiments. The method 100 may be implemented using one or more of the features described above with reference to the personnel transfer device 10. Thus, one or more aspects discussed above with reference to the personnel transfer device 10 may also apply to the method 100.

The method 100 begin at block 102 where an existing personnel transfer device is provided. For example, consider an existing personnel transfer device, similar in some respects to the personnel transfer device 10, but without one or more of the floatation modules 60, the PHC 70, the emergency seat 80, the cushioned landing pads 82, or the metal grated flooring 88. In some examples, the one or more of the floatation modules 60, the PHC 70, the emergency seat 80, the cushioned landing pads 82, or the metal grated flooring 88, or combinations thereof, may be provided as part of a retrofit kit or system for retrofitting an existing personnel transfer device. In some embodiments, the existing personnel transfer device may include a base, a top, a support column, and a plurality of generally peripherally-disposed cables extending between the base and the top, as described above.

The method proceeds to block 104 where one or more components of the existing personnel transfer device (provided at block 102) are modified or replaced. In an embodiment of block 104, some exemplary modifications to existing portions of a support column, a top portion of the frame, and a bottom portion of the frame including a platform for riders of the personnel transfer device are illustrated in FIGS. 12A, 12B, 13A, 13B, 14A, 14B, 15-16. In some examples, an upper portion of the existing support column may have an end cap removed and openings may be formed (or otherwise provided) on either side of the existing upper portion to provide the upper portion 68 of the support column 16 (FIGS. 12A, 12B), and openings may be formed (or otherwise provided) on either side of the existing intermediate coupler to provide the intermediate coupler 84 (FIGS. 13A, 13B). In the exemplary configurations of FIGS. 12A, 13A, single openings 91 on each side of the upper portion 68 of the support column 16 may align with single openings 93 in the intermediate coupler 84 to provide for coupling of the upper portion 68 to the intermediate coupler 84 (e.g., using a bolt, nut, pin, or other means for securing through the corresponding aligned openings). Alternatively, in the exemplary configurations of FIGS. 12B, 13B, multiple openings 91 in the upper portion 68 of the support column 16 may align with multiple openings 93 in the intermediate coupler 84 to provide for coupling of the upper portion 68 to the intermediate coupler 84 (e.g., using a bolt, nut, pin, or other means for securing through the corresponding aligned openings). Further, in some embodiments, a lower portion of the existing support column may have end caps removed from both ends, openings may be added for grease fittings (greasing points or greasing openings 95), for a charging port (filling connection or charging port openings 97), for a pressure gauge connection, and a plate with an opening therethrough may be added for mounting a passive heave compensator to provide the lower portion 69 of the support column 16 (FIGS. 14A, 14B). In addition, an opening may be formed in the existing roof to provide the opening 67 in the roof 40 (which may include a corresponding opening at the top end of the upper portion 68 of the support column 16) (FIG. 15). Thereafter a passive heave compensator (e.g., such as the PHC 70) may be installed within the support column 16, as previously described. In some embodiments, a gasket (e.g., such as a urethane gasket) may also be installed within the opening 67 so that the sling 63 attached to the second end of the passive heave compensator will not directly rub on metal of the frame at the opening 67.

In a further embodiment of block 104, and as an example of other exemplary modifications that may be performed, an existing platform may include a solid floor plate, a central portion of which may be cut out and a metal grated flooring added to provide the metal grated flooring 88 that is concentric with, and between each of, the platform 28 and the support column 16 (e.g., See FIG. 16). Also, in various cases and in another embodiment of block 104, floatation modules (e.g., such as the floatation modules 60) may be coupled (e.g., bolted, clipped, clamped, or otherwise attached) to an upper portion of an existing pair of adjacent cables (e.g., such as cables 18), configured as described above. In still another embodiment of block 104, the emergency seat 80 and/or the cushioned landing pads 82 may be added to an existing personnel transfer device, configured as discussed above. In some cases, a padding surrounding the base spreader ring 20 in the provided existing personnel transfer device may include a buoyant padding. Thus, in some embodiments of block 104, the buoyant padding surrounding the base spreader ring 20 may be replaced with the non-buoyant padding 30, as discussed above. Similarly, a padding surrounding the top spreader ring 32 in the provided existing personnel transfer device may include a buoyant padding. Thus, in some embodiments of block 104, the buoyant padding surrounding the top spreader ring 32 may be replaced with the non-buoyant padding 42 (or non-buoyant bumper), as discussed above.

In at least some cases, and in an alternative embodiment of block 104, rather than making modifications to an existing support column, an entirety of the existing support column may instead be swapped out with the disclosed support column 16, having the various features as described herein and including the PHC 70. Similarly, in some cases and in another alternative embodiment of block 104, rather than making modifications to an existing roof, an entirety of the existing roof and/or top may instead be swapped out with the disclosed roof 40 and/or top 14, having the various features as described herein and including the opening 67. Further, in some cases and in yet another alternative embodiment of block 104, rather than making modifications to an existing platform, an entirety of the existing platform and/or base may instead be swapped out with the disclosed platform 28 and/or base 12, having the various features as described herein and including the metal grated flooring 88. It will be understood that, in various embodiments, additional steps may be implemented before, during, and/or after the method 100, and some steps may be replaced or eliminated in accordance with various embodiments of the method 100. Various other modifications to the method 100 are possible and will become apparent to one skilled in the art having benefit of the present disclosure.

Thus, a personnel transfer device, and related methods, that may be used for offshore personnel transfer have been provided. In some embodiments, the personnel transfer device may be lifted and transported using a sling set attached to a frame top portion, the sling set further coupled to a crane, hoist, or other lifting machine. In accordance with various embodiments, the personnel transfer device including a number of integrated safety features such as self-righting floatation, passive heave compensation (e.g., to provide softer pickups and takeoffs), softer cushioned landings, enhanced side impact protection, emergency seating, a floor grating for improved viewing (e.g., by onboard personnel) during landing, or combinations thereof. As previously noted, the various embodiments disclosed herein may be equally applied to a four (4)-person personnel transfer device, a six (6)-person personnel transfer device, an eight (8)-person personnel transfer device, a ten (10)-person personnel transfer device, or a twelve (12)-person personnel transfer device. Further, in addition to providing the disclosed personnel transfer device, aspects of the present disclosure also provide methods for retrofitting an existing personnel transfer device to include one or more of the advantageous integrated safety features described herein. The embodiments disclosed herein significantly mitigate the potential risk of personal injury while also greatly improving rider comfort.

The foregoing is not intended to limit the present disclosure to the precise forms or particular fields of use disclosed. As such, it is contemplated that various alternate embodiments and/or modifications to the present disclosure, whether explicitly described or implied herein, are possible. Persons of ordinary skill in the art in possession of the present disclosure will recognize that changes may be made in form and detail without departing from the scope of what is claimed.

What is claimed is:

1. A personnel transfer device, comprising:

a base;

a top;

a plurality of generally peripherally-disposed cables extending between the base and the top;

a generally centrally-disposed support column coupled between the base and the top for maintaining a generally-fixed distance between the base and the top and for providing tension in the plurality of generally peripherally-disposed cables extending between the base and the top;

a heave compensator configured to provide damping of motion of a first end thereof relative to a second end thereof, the heave compensator disposed generally longitudinally within a lateral extent of the generally centrally-disposed support column, wherein the first end of the heave compensator is attached to the generally centrally-disposed support column, and wherein the second end of the heave compensator is configured for coupling to a master link assembly for lifting of the personnel transfer device;

a plurality lift points disposed along a top portion of the top, wherein the plurality of lift points are configured for attachment of a set of slings for coupling the top to the master link assembly for lifting of the personnel transfer device; and a heave compensation sling coupled between the second end of the heave compensator and the master link assembly, wherein upon initiation of the lifting of the personnel transfer device, the heave compensation sling is configured to engage prior to engagement of the set of slings.

2. The personnel transfer device of claim 1, wherein the heave compensator is disposed coaxially with respect to the generally centrally-disposed support column.

3. The personnel transfer device of claim 1, wherein the heave compensator includes a passive heave compensator.

4. The personnel transfer device of claim 1, wherein a center of mass of the heave compensator is disposed within a lower portion of the generally centrally-disposed support column.

5. The personnel transfer device of claim 1, further comprising:

plural floatation modules coupled to upper portions of respective pairs of adjacent cables of the plurality of generally peripherally-disposed cables, a first lateral end of each floatation module attached to an upper portion of a first cable of one of the respective pairs of adjacent cables of the plurality of generally peripherally-disposed cables, and a second lateral end of each floatation module attached to an upper portion of a second cable of the one of the respective pairs of adjacent cables of the plurality of generally peripherally-disposed cables.

6. The personnel transfer device of claim 5, wherein the plural floatation modules at least partly define a center of buoyancy of the personnel transfer device, and wherein a center of gravity of the personnel transfer device is disposed below the center of buoyancy.

7. The personnel transfer device of claim 1, wherein when the personnel transfer device is disposed in a body of water, a distance between a bottom surface of the top and a top surface of the body of water is at least 24 inches.

8. The personnel transfer device of claim 1, wherein each respective sling of the set of slings has a first length, and wherein the heave compensation sling has a second length greater than the first length.

9. The personnel transfer device of claim 1, wherein engagement of the heave compensation sling, prior to engagement of the set of slings, is configured to dampen dynamic forces on the personnel transfer device during the lifting of the personnel transfer device.

10. The personnel transfer device of claim 1, wherein the plurality of generally peripherally-disposed cables are attached to the base and to the top at corresponding spaced apart locations, and wherein each of the cables has a substantially equal length between a base attachment location and a top attachment location so that tension in the cables causes the top to be substantially parallel to the base.

11. The personnel transfer device of claim 1, wherein the plurality of generally peripherally-disposed cables are attached to the base and to the top at corresponding spaced apart locations toward a periphery of the base and a periphery of the top and further comprising:

a set of inner cables attached to the base and to the top at corresponding spaced apart locations, the set of inner cables attached toward a center of the base and the top.

12. The personnel transfer device of claim 11, further comprising:

a first coupling attached to the base for coupling of the generally centrally-disposed support column to the base;

a second coupling attached to the top for coupling of the generally centrally-disposed support column to the top; and a metal grated flooring extending between the first coupling and the set of inner cables.

13. The personnel transfer device of claim 12, wherein the base further comprises a base spreader ring and a first support structure extending at least partially between the base spreader ring and the first coupling; and wherein the top further comprises a top spreader ring and a second support structure extending at least partially between the top spreader ring and the second coupling.

14. A personnel transfer device, comprising:

a base;

a top;

a plurality of generally peripherally-disposed cables extending between the base and the top;

a generally centrally-disposed support column coupled between the base and the top for maintaining a generally-fixed distance between the base and the top and for providing tension in the plurality of generally peripherally-disposed cables extending between the base and the top;

a heave compensator configured to provide damping of motion of a first end thereof relative to a second end thereof, the heave compensator disposed generally longitudinally within a lateral extent of the generally centrally-disposed support column, wherein the first end of the heave compensator is attached to the generally centrally-disposed support column, and wherein the second end of the heave compensator is configured for coupling to a master link assembly for lifting of the personnel transfer device;

plural floatation modules coupled to upper portions of respective pairs of adjacent cables of the plurality of generally peripherally-disposed cables, a first lateral end of each floatation module attached to an upper portion of a first cable of one of the respective pairs of adjacent cables of the plurality of generally peripherally-disposed cables, and a second lateral end of each floatation module attached to an upper portion of a second cable of the one of the respective pairs of adjacent cables of the plurality of generally peripherally-disposed cables; and an opening beneath each of the plural floatation modules, the opening extending from a bottom surface of each of the plural floatation modules to a top surface of the base.

15. The personnel transfer device of claim 14, wherein each of the plural floatation modules has a total volume of about 2 cubic feet.

16. The personnel transfer device of claim 14, wherein each of the plural floatation modules is configured to provide protection from side impacts to the personnel transfer device.

17. The personnel transfer device of claim 14, further comprising:

a plurality lift points disposed along a top portion of the top;

wherein the plurality of lift points are configured for attachment of a set of slings for coupling the top to the master link assembly for lifting of the personnel transfer device.

18. The personnel transfer device of claim 17, further comprising:

a heave compensation sling coupled between the second end of the heave compensator and the master link assembly, wherein upon initiation of the lifting of the personnel transfer device, the heave compensation sling is configured to engage prior to engagement of the set of slings.

19. A method of retrofitting a personnel transfer device having a base, a top, and a plurality of generally peripherally-disposed cables extending between the base and the top and in which, when the personnel transfer device is configured for transport operations, a generally fixed distance between the base and the top is maintained together with tension in the plurality of generally peripherally-disposed cables extending between the base and the top, the method comprising:

providing a generally centrally-disposed support column;

providing a heave compensator disposed generally within the generally centrally-disposed support column, wherein a first end of the heave compensator is attached to the generally centrally-disposed support column, and wherein a second end of the heave compensator is configured for coupling to a master link assembly for lifting of the personnel transfer device during the transport operations; and replacing a buoyant padding surrounding the base with a non-buoyant padding or non-buoyant bumper.

20. The method of claim 19, further comprising:

replacing an existing support column with the generally centrally-disposed support column having the heave compensator disposed generally therewithin, the replacing reestablishing the generally fixed distance between the base and the top and the tension in the plurality of generally peripherally-disposed cables extending between the base and the top.

21. The method of claim 19, further comprising:

fixedly attaching floatation modules to upper portions of respective pairs of adjacent ones of the plurality of generally peripherally-disposed cables.

22. The method of claim 19, further comprising:

fixedly attaching floatation modules to upper portions of at least a respective one of the plurality of generally peripherally-disposed cables and the top.

23. An apparatus for marine applications, comprising:

a personnel transfer device;

a heave compensator configured to be disposed generally longitudinally within a lateral extent of a generally centrally-disposed support column of the personnel transfer device, wherein a first end of the heave compensator is configured to be attached to the generally centrally-disposed support column, and wherein a second end of the heave compensator is configured for coupling to a master link assembly for lifting of the personnel transfer device;

plural floatation modules, wherein each floatation module is attachable between upper portions of a pair of respective generally peripherally-disposed cables of the personnel transfer device; and an opening beneath each of the plural floatation modules, the opening extending from a bottom surface of each of the plural floatation modules to a top surface of a base of the personnel transfer device.

24. The apparatus for marine applications of claim 23, wherein the heave compensator is disposed generally longitudinally within the lateral extent of the generally centrally-disposed support column of the personnel transfer device, wherein the first end of the heave compensator is attached to the generally centrally-disposed support column, and wherein each floatation module is attached to the upper portion of the respective generally peripherally-disposed cable of the personnel transfer device.

25. The apparatus for marine applications of claim 23, further comprising:

a plurality lift points disposed along a top portion of the personnel transfer device;

wherein the plurality of lift points are configured for attachment of a set of slings for coupling the top portion of the personnel transfer device to the master link assembly for lifting of the personnel transfer device; and a heave compensation sling coupled between the second end of the heave compensator and the master link assembly, wherein upon initiation of the lifting of the personnel transfer device, the heave compensation sling is configured to engage prior to engagement of the set of slings.

* * * * *